US009691278B2

(12) United States Patent
Poornachandran et al.

(10) Patent No.: US 9,691,278 B2
(45) Date of Patent: Jun. 27, 2017

(54) SYSTEMS AND METHODS FOR TRAFFIC CONTROL

(71) Applicant: McAfee, Inc., Santa Clara, CA (US)

(72) Inventors: Rajesh Poornachandran, Portland, OR (US); Ned M. Smith, Beaverton, OR (US); Vincent J. Zimmer, Federal Way, WA (US); Saurabh Dadu, Tigard, OR (US); Sven Schrecker, Santa Clara, CA (US)

(73) Assignee: McAfee, Inc., Santa Clara, CA (US)

( * ) Notice: Subject to any disclaimer, the term of this patent is extended or adjusted under 35 U.S.C. 154(b) by 152 days.

(21) Appl. No.: 14/811,413

(22) Filed: Jul. 28, 2015

(65) Prior Publication Data

US 2017/0032670 A1 Feb. 2, 2017

(51) Int. Cl.
*G08G 1/07* (2006.01)
*G08G 1/087* (2006.01)

(52) U.S. Cl.
CPC ..... *G08G 1/087* (2013.01)

(58) Field of Classification Search
CPC ..... G08G 1/087
USPC ..... 340/902, 906
See application file for complete search history.

(56) References Cited

U.S. PATENT DOCUMENTS 5,926,113 A * 7/1999 Jones ..... G08G 1/07 340/906
6,958,707 B1 10/2005 Siegel
8,742,945 B2 * 6/2014 Brynielsson ..... G08G 1/087 340/906
8,773,282 B2 * 7/2014 Cross ..... G08G 1/087 340/906
9,254,781 B2 * 2/2016 Applebaum ..... B60Q 1/00
9,299,253 B2 * 3/2016 Eichhorst ..... G08G 1/087
2004/0196162 A1 * 10/2004 Brooke ..... G08G 1/20 340/906

(Continued)

FOREIGN PATENT DOCUMENTS

KR 20060107262 10/2006
KR 20080079918 9/2008

OTHER PUBLICATIONS

International Search Report and Written Opinion for PCT Application No. PCT/US2016/033932, mailed Oct. 20, 2016, 11 pages.

*Primary Examiner* — Ojiako Nwugo
(74) *Attorney, Agent, or Firm* — Eversheds-Sutherland (US) LLP

(57) ABSTRACT

Systems and methods for real-time emergency vehicle authentication at traffic signal and tollgates are disclosed. In certain example embodiments, a dispatch server can provide identifying credentials and time-bounded intersection tickets (TBIT) to traffic signals and tollgates for conducting authentication of emergency vehicles. The emergency vehicles can transmit a traffic light control message requesting expedited access through a traffic signal or tollgate. The traffic signal or tollgate can decrypt the message using the TBIT. It can further determine if the identifying credential received from the emergency vehicle is authorized for expedited access and if the message was received within a required time period. In response, the traffic signal or tollgate can determine its current signal or gate position and determine if a change needs to be made to provide expedited access to the emergency vehicle.

20 Claims, 10 Drawing Sheets

(56) References Cited

U.S. PATENT DOCUMENTS

| | | | | |
|---|---|---|---|---|
| 2005/0104745 | A1* | 5/2005 | Bachelder | F41G 9/00 340/906 |
| 2008/0088478 | A1* | 4/2008 | Shillman | G08G 1/095 340/928 |
| 2010/0069079 | A1* | 3/2010 | Higuchi | H04W 16/10 455/450 |
| 2011/0169661 | A1* | 7/2011 | Eichhorst | G08G 1/087 340/906 |
| 2012/0176254 | A1 | 7/2012 | Imanaga et al. | |
| 2014/0278029 | A1 | 9/2014 | Tonguz et al. | |
| 2014/0354449 | A1* | 12/2014 | Alam | G08G 1/0965 340/902 |
| 2015/0243165 | A1* | 8/2015 | Elsheemy | B60R 25/00 340/906 |

* cited by examiner

SYSTEMS AND METHODS FOR TRAFFIC CONTROL

TECHNICAL FIELD

This disclosure generally relates to traffic control and management and more specifically to systems and methods for real-time vehicle authentication and corresponding management of traffic signs and signals.

BACKGROUND

Traffic signal controllers support emergency vehicle preemption logic by detecting the light modulated output from an approaching emergency vehicle's mounted emitter. The purpose is to provide a green light for the emergency vehicle as soon as possible or to hold an existing green light. To obtain a green light, existing green lights, including pedestrian intervals, are abbreviated or skipped. After the yellow change interval, a green light is given to the approaching emergency vehicle. The type of signal preemption used for emergency vehicles is a modulated strobe light. A detector at the signal receives light modulated output from a vehicle-mounted emitter.

One significant issue regarding emergency vehicle preemption logic is the potential for fraudulent use or misuse. It can be difficult to capture the misuse of the preemption logic at a traffic signal or tollgate by malicious users. For example, it can be very easy for someone to replicate the emergency strobe lights on their vehicle. Similarly, it can be difficult to capture the misuse of the preemption logic by genuine emergency services professionals (e.g., police officers, emergency medical technicians, fire department personal, and the like). For example, the emergency personnel may activate the strobe light in the emergency vehicle even though the vehicle is not responding to an emergency situation and/or is not allowed to do this legally. Furthermore, there may be other reasons for use of the emergency vehicle preemption logic. For example, currently it is not feasible to quickly "deputize" a citizen and give the vehicle of the citizen the capability to use the emergency vehicle preemption logic. The ability to "deputize" the vehicle of a normal citizen during an emergency situation would be useful in life-saving emergency situations.

BRIEF DESCRIPTION OF THE FIGURES

Reference will now be made to the accompanying drawings, which are not necessarily drawn to scale, and wherein.

DETAILED DESCRIPTION OF EXAMPLE EMBODIMENTS

Figure 1:
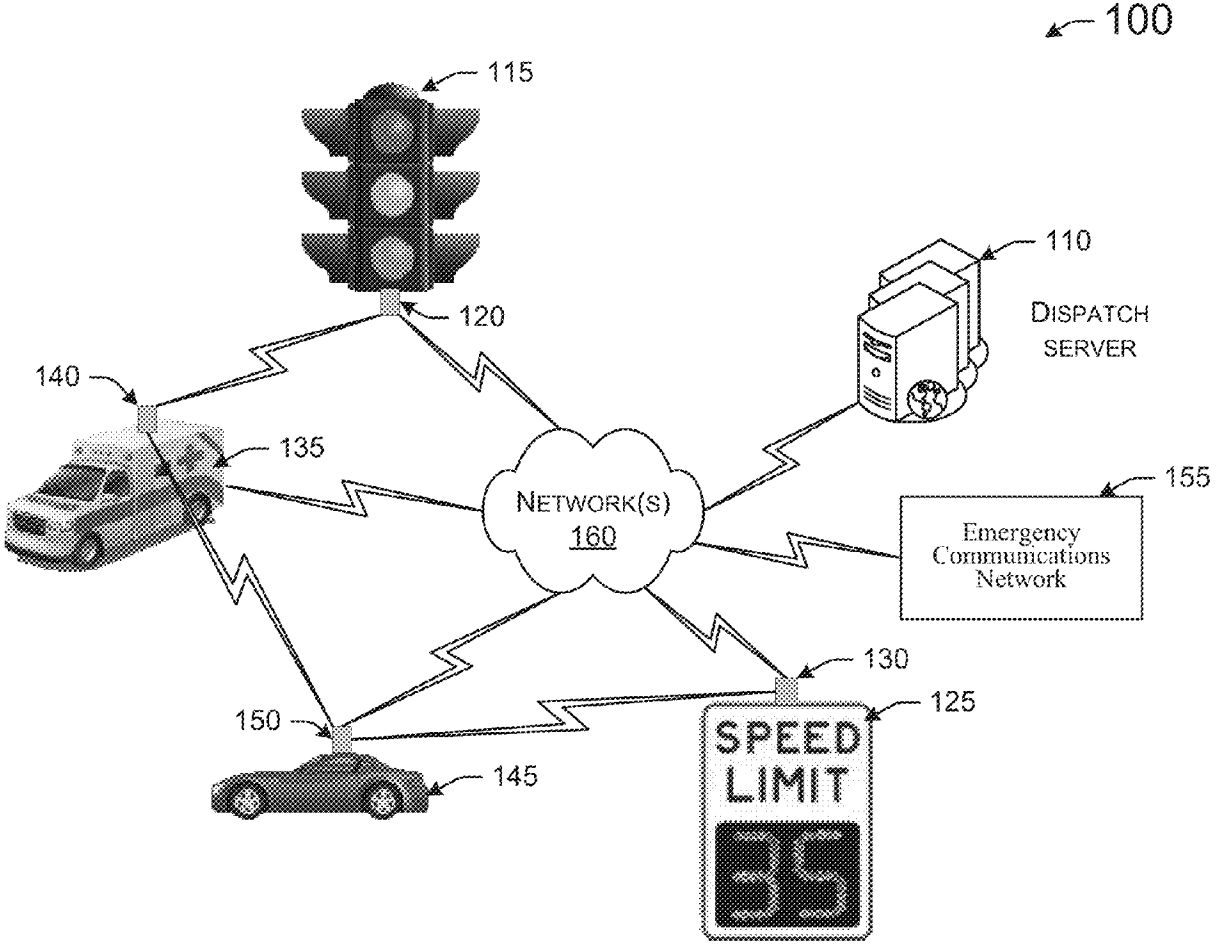
FIG. 1 is a simplified diagram illustrating an example operating environment including a dispatch server, regular and emergency vehicles, traffic signals, and traffic control displays providing real-time vehicle authentication and corresponding management of traffic signs and signals, in accordance with example embodiments of the disclosure.

Embodiments of the disclosure are described more fully hereinafter with reference to the accompanying drawings, in which example embodiments of the disclosure are shown. This disclosure may, however, be embodied in many different forms and should not be construed as limited to the example embodiments set forth herein; rather, these embodiments are provided so that this disclosure will be thorough and complete, and will fully convey the scope of the invention to those skilled in the art. Like numbers refer to like, but not necessarily the same or identical, elements throughout.

Embodiments of the disclosure may provide systems and methods for real-time vehicle authentication and corresponding management of traffic signs and signals. In one example, information about an emergency vehicle may be received by a dispatch server. The information may include the vehicle type (e.g., make/model, commercial, residential, farm, emergency responder, police car, ambulance, fire truck). In addition, the information may include the safety features and capabilities of the vehicle (e.g., anti-lock braking systems, active or passive crash-avoidance systems, four-wheel drive, all-wheel drive, dynamic stability, tire type, etc.). This information can be provided by the vehicle manufacturer at the time the vehicle is manufactured or alternatively provided at a subsequent time. The dispatch server may generate credentials that identify the vehicle (or it may use the vehicle's vehicle identification (VIN) number) and may associate the vehicle identifying credentials with the provided information and may transmit the vehicle identifying credentials to the vehicle or a user who can upload them onto the vehicle.

During an emergency event, the dispatch server may receive information (e.g., the identifying credentials and vehicle route) for an emergency/deputized vehicle that is responding to the emergency event. The dispatch server may determine the traffic signals (e.g., traffic lights) and/or tollgates along the received vehicle route. The dispatch server may also determine the current location of the emergency vehicle and determine an approximate time that the emergency vehicle will get to each of the identified traffic signals and/or tollgates along the route. The dispatch server may transmit a time-bound intersection ticket (TBIT) and the identifying credentials for the emergency vehicle to each of the traffic signals and/or tollgates along the route. The dispatch server may also transmit a TBIT to the emergency vehicle for use when the vehicle encounters a traffic signal or tollgate. Each TBIT may be limited in use to a particular time period or bounded time. If not used in that time period, the expedited access by the traffic signal or through the tollgate would not be granted.

As the emergency vehicle approaches a traffic signal or tollgate, an on-board computer in the vehicle generates an encrypted traffic light control message (TLCM) that it transmits or otherwise broadcasts for reception by the traffic signal. The traffic signal receives the TLCM and decrypts the message using a key received from the dispatch server. Alternatively, the traffic signal may transmit the TLCM to the dispatch server for decryption and evaluation. Information in the TLCM is evaluated (by the traffic signal or the dispatch server) against one or more requirements to determine whether to grant the emergency vehicle expedited access. The requirements may include whether the vehicle identifying credentials in the TLCM match the vehicle identifying credentials sent to the traffic signal by the dispatch server, whether the time the TLCM was received is within the bounded time period of the TBIT, and/or whether a TLCM has already been received for the particular emergency vehicle or other constraints. If the requirements are satisfied, the traffic signal or tollgate may determine if it needs to be changed/opened to provide expedited access to the emergency vehicle. For example, if the traffic light is already green in the direction of travel of the emergency vehicle, the traffic signal would not need to change and would instead maintain the green light for a predetermined amount of time to allow the emergency vehicle to pass through the traffic light. On the other hand, if the traffic light is red in the direction of travel of the emergency vehicle, then the traffic signal will conduct a controlled change of the lights at the intersection and provide a green light in the direction of the route of the emergency vehicle.

In another example embodiment, information about a vehicle may be received by a dispatch server. The information may include the vehicle type (e.g., make/model, car, truck, van commercial, residential, farm, emergency responder, etc.). In addition, the information may include the safety features and capabilities of the vehicle (e.g., anti-lock braking systems, active or passive crash-avoidance systems, four-wheel drive, tire type, etc.). This information can be provided by the vehicle manufacturer at the time the vehicle is manufactured or alternatively provided at a subsequent time. The dispatch server may generate credentials that identify the vehicle (or it may use the vehicle's VIN number) and may associate the vehicle identifying credentials with the provided information and may transmit the vehicle identifying credentials to the vehicle or a user who can upload them onto the vehicle.

During operation, the vehicle may transmit or otherwise broadcast a speed request message to a traffic control display (e.g., speed limit sign, dynamic traffic control sign, etc.). The speed request message may be encrypted and can include the vehicle's identifying credentials. The traffic control display can receive the speed request message and forward it on to the dispatch server. The dispatch server may decrypt the message and determine the vehicle's identifying credentials. The dispatch server may then compare the received identifying credentials to stored identifying credentials for multiple vehicles to identify a match. Once a match is identified, the dispatch server may determine the vehicle type, capabilities, and/or safety features associated with the matching stored identifying credentials. The dispatch server may also determine the location of the vehicle, the current traffic level of that location, the current road conditions (e.g., wet, dry, ice, snow), and/or the current weather conditions and may determine a recommended speed for the vehicle based on one or more of these factors along with vehicle type, capabilities, and/or safety features of that vehicle. The dispatch server may transmit the recommended speed to the traffic control display. The traffic control display may receive the recommended speed and display it for viewing by the user of the vehicle. In one example embodiment, the recommended speed may also be transmitted to the vehicle (e.g., either by the dispatch server or the traffic control display) and may be displayed on a display device inside the vehicle.

FIG. 1 is a simplified block diagram illustrating an example operating environment 100 including a dispatch server, regular and emergency vehicles, traffic signals, and traffic control displays providing real-time vehicle authentication and corresponding management of traffic control displays and signals, in accordance with example embodiments of the disclosure. The example operating environment 100 may include one or more dispatch servers 110 (referred to herein as a "dispatch server") that can be communicably coupled to one or more traffic signals and tollgates 115, one or more traffic control displays 125, one or more emergency vehicles 135 one or more non-emergency vehicles 145 (referred to herein simply as a "vehicle") and one or more emergency communications networks 155 via, for example, a network 160.

The dispatch server 110 can be a cloud-based server that can be configured to receive emergency vehicle identifying credentials (e.g., a unique vehicle identifier, VIN number) that uniquely identifies a particular emergency vehicle 135 and route information for the particular emergency vehicle 135 from an emergency communications network 155. The information may be received via the network 160 and/or an automated call center system communicably coupled to the dispatch server 110. The dispatch server may also be configured to generate time-bounded intersection tickets and provide them via the network 160 to one or more traffic signals and tollgates 115 (e.g., based on the routing information provided by the emergency communications network 155) and one or more emergency vehicles 135 (based on the emergency vehicle identifying credentials provided by the emergency communications network 155) to provide expedited access for the emergency vehicle through the traffic signals and tollgates 115 while the emergency vehicles are responding to an emergency situation. In one example, the dispatch server may implement a simple key distribution center (SKDC) that issues a series of TBITs according to the emergency vehicle's intended route. The dispatch server 110 can also be configured to receive vehicle characteristic information (such as vehicle type, vehicle capabilities, and vehicle safety features) for emergency vehicles 135 and vehicles 145, can determine recommended speed limits for emergency vehicles 135 and vehicles 145 requesting such information and can transmit that recommended speed limit for display on one or more traffic control displays 125 and/or on a display of the emergency vehicle 135 or vehicle 145 making the request. The dispatch server 110 may also support vehicle-to-vehicle communication and verification during emergency situations by receiving emergency vehicle identifying credentials from a vehicle 145 via the network 160, verifying the emergency vehicle transmission is authentic, determining the location of the emergency vehicle 135 and the vehicle 145 as well as the route the emergency vehicle 135 is taking and transmitting the location and routing information to the vehicle 145 via the network 160 to support the vehicle 145 determining a path to get out of the way of the emergency vehicle 135.

The traffic signals and tollgates 115 can be communicably coupled (either directly or via the network 160) to one or more of the one or more emergency vehicles 135, the one or more vehicles 145, and the dispatch server 110. In one example embodiment, traffic signals may include traffic lights, traffic signs, or any other device used to control the flow of vehicles through an intersection. In one example embodiment, each traffic signal and/or tollgate 115 or a group of traffic signals and/or tollgates at a single location may include an internet of things (IoT) device 120 to communicably couple the traffic signals and/or tollgates 115 to and provide a communication platform with the other various emergency vehicles 135, vehicles 145, and/or the dispatch server 110. In one example, the IoT device 120 can provide a unique IP address for each traffic light and/or tollgate 115 or each group thereof, can provide wireless and/or wired access to the Internet, and can be configured to receive and provide communications to one or more processors associated with each traffic signal and/or tollgate 115 or each grouping thereof. For example, all of the traffic signals 115 and/or associated IoT devices 120 at a particular intersection may be communicably coupled to a processor or group of processors for controlling the light-changing methodology of the group of traffic signals 115 (e.g., a traffic control cabinet that includes a traffic signal controller positioned in the vicinity of the group of traffic signals 115). In such an embodiment, a single IoT device 120 may be provided for each individual traffic signal 115 or for the group of traffic signals 115. Similarly the tollgate or group of tollgates may include or be communicably coupled to a processor or group of processors for controlling the position of tollgates (e.g., a traffic control cabinet that includes a tollgate controller positioned in the vicinity of the tollgate or group of tollgates). In such an embodiment, a single IoT device 120 may be provided for each individual tollgate or for the group of tollgates and may be communicably coupled to the tollgate controller. The IoT device 120 may include or be communicably coupled to a receiver and transmitter or transceiver (not shown) for receiving and transmitting wireless signals and may further include or be communicably coupled to an antenna (not shown), which may further be coupled or communicably coupled to the transceiver for wireless communication. Further, the logic and/or procedures described with reference to the IoT device 120 hereinbelow may be performed and secured within a tamper-resistant Trusted Execution Environment (TEE) to prevent unauthorized modification.

The traffic control display can be configured to provide individualized speed limit and other driving condition information for vehicles 145 and/or emergency vehicles 135. The traffic control display 125 can be communicably coupled (either directly or via the network 160) to one or more of the one or more emergency vehicles 135, the one or more vehicles 145, and the dispatch server 110. The traffic control display 125 can include, but is not limited to, a speed limit sign or a dynamic traffic control sign. Each traffic control display can include an IoT device 130 to communicably couple the traffic control display 125 to and provide a communication platform with the various emergency vehicles 135, vehicles 145, and/or the dispatch server 110 and to receive instructions and modify a dynamic display of the traffic control display 125. In one example, the IoT device 130 can provide a unique IP address for the traffic control display, can provide wireless and/or wired access to the Internet, and can be configured to receive from and provide communications to one or more processors of the traffic control display 115. The IoT device 130 may include or be communicably coupled to a receiver and transmitter or transceiver (not shown) for receiving and transmitting wireless signals and may further include or be communicably coupled to an antenna (not shown), which may further be coupled or communicably coupled to the transceiver for wireless communication. Further, the logic and/or procedures described with reference to the IoT device 130 hereinbelow may be performed and secured within a tamper-resistant TEE to prevent unauthorized modification.

The one or more emergency vehicles 135 can be communicably coupled (either directly or via the network 160) to one or more of the one or more traffic signals and tollgates 115, the one or more traffic control displays 125, the one or more vehicles 145, and the dispatch server 110. Emergency vehicles 135 can include, but are not limited to, emergency responder vehicles, police cars, ambulances, fire trucks, first responders, or any other type of emergency vehicle. Each emergency vehicle 135 can include an IoT device 140 to communicably couple the emergency vehicle to and provide a communication platform with the various traffic signals and tollgates 115, traffic control displays 125, vehicles 145, and the dispatch server 110 and to receive, facilitate storage, and transmit TBITs received from the dispatch server 110. In one example, the IoT device 140 can be communicably coupled to the on-board computer for the emergency vehicle 135. The IoT device 140 can also provide a unique IP address for the particular emergency vehicle 135, can provide wireless access to the Internet, and can be configured to receive from and provide communications to the on-board computer of the emergency vehicle 135. The IoT device 140 may include or be communicably coupled to a receiver and transmitter or transceiver (not shown) for receiving and transmitting wireless signals and may further include or be communicably coupled to an antenna (not shown), which may further be coupled or communicably coupled to the transceiver for wireless communication. Further, the logic and/or procedures described with reference to the IoT device 140 hereinbelow may be performed and secured within a tamper-resistant TEE to prevent unauthorized modification.

The one or more vehicles 145 can be communicably coupled (either directly or via the network 160) to one or more of the one or more traffic signals and tollgates 115, the one or more traffic control displays 125, the one or more emergency vehicles 135, and the dispatch server 110. Vehicles 145 can include any type of vehicle that is not considered to be an emergency vehicle at that particular moment. This includes vehicles that may be "deputized" for certain emergency events for a temporary period of time as discussed below. Each vehicle 145 can include an IoT device 150 to communicably couple the vehicle 145 to and provide a communication platform with the various traffic signals and tollgates 115, traffic control displays 125, emergency vehicles 135, and the dispatch server 110, to receive emergency notifications from nearby emergency vehicles 135 and to transmit speed request messages and emergency notifications. In one example, the IoT device 150 can be communicably coupled to the on-board computer for the vehicle 145. The IoT device 150 can also provide a unique IP address for the particular vehicle 145, can provide wireless access to the Internet, and can be configured to receive from and provide communications to the on-board computer of the vehicle 145. The IoT device 150 may include or be communicably coupled to a receiver and transmitter or transceiver (not shown) for receiving and transmitting wireless signals and may further include or be communicably coupled to an antenna (not shown), which may further be coupled or communicably coupled to the transceiver for wireless communication. Further, the logic and/or procedures described with reference to the IoT device 150 hereinbelow may be performed and secured within a tamper-resistant TEE to prevent unauthorized modification.

One or more emergency communications networks 155 may be communicably couple to the dispatch server via the network 160. The emergency communications network 155 includes, but is not limited to, emergency dispatch service at the city level, county level, state level, or federal level, including those services connected to the 911 emergency telephone system. In one example embodiment, the emergency communications network 155 can provide identifying credentials and route information for emergency vehicles responding to an emergency situation to the dispatch server 110 via the network 160.

The networks 160 may include any one or a combination of different types of suitable communications networks, such as cable networks, the Internet, wireless networks, cellular networks, and other private and/or public networks. Furthermore the networks 130 may include any variety of medium over which network traffic is carried including, but not limited to, coaxial cable, twisted wire pair, optical fiber, hybrid fiber coaxial (HFC), microwave terrestrial transceivers, radio frequency communications, satellite communications, or combinations thereof.

Figure 2:
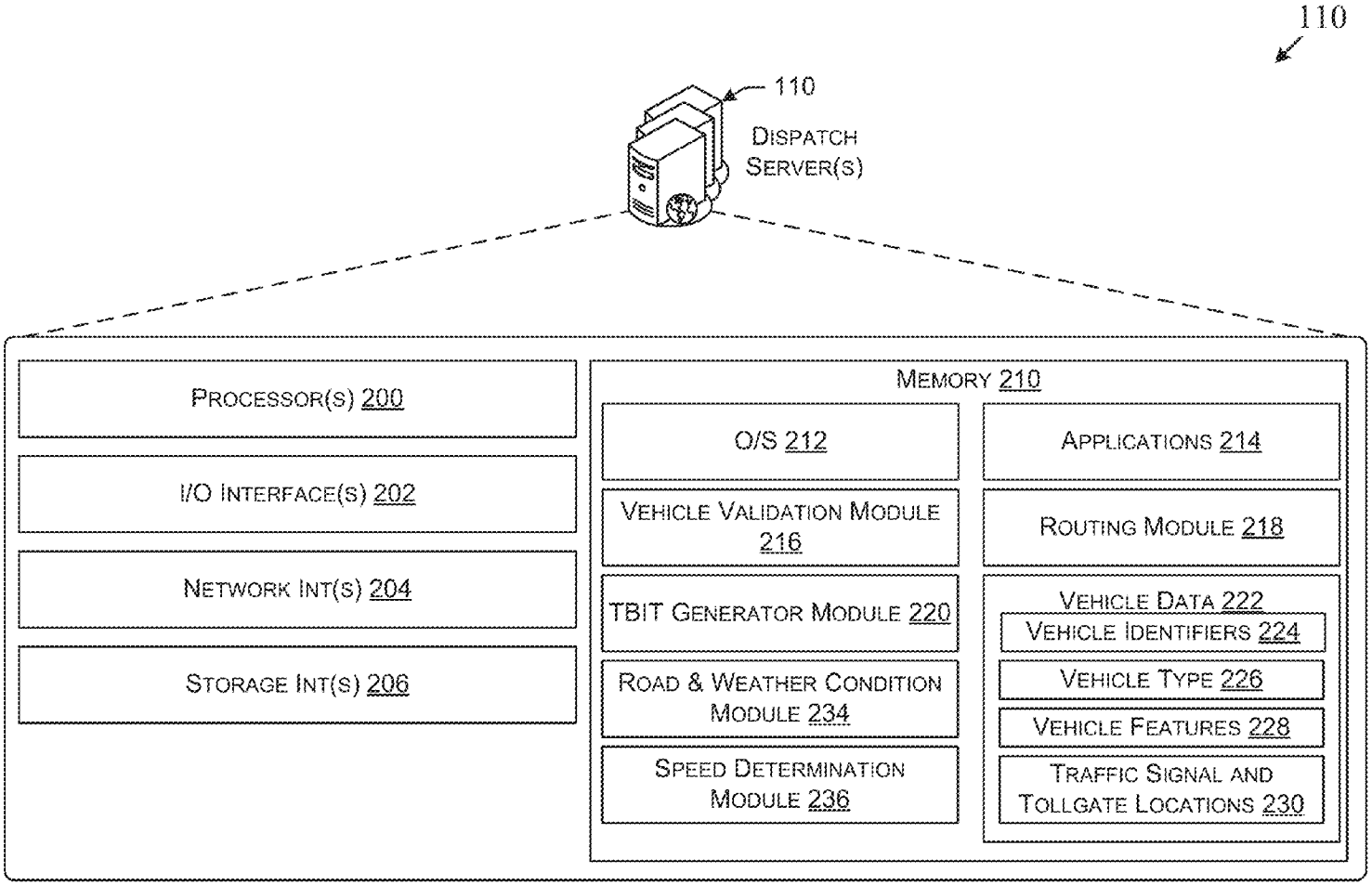
FIG. 2 is a simplified block diagram illustrating an example architecture of a dispatch server, in accordance with example embodiments of the disclosure.

FIG. 2 is a simplified block diagram illustrating an example architecture of a dispatch server 110, in accordance with example embodiments of the disclosure. The dispatch server 110 may include one of more processors 200, I/O interface(s) 202, network interface(s) 204, storage interface (s) 206, and memory 210.

In some examples, the processors 200 of the dispatch servers 110 may be implemented as appropriate in hardware, software, firmware, or combinations thereof. Software or firmware implementations of the processors 200 may include computer-executable or machine-executable instructions written in any suitable programming language to perform the various functions described. Hardware implementations of the processors 200 may be configured to execute computer-executable or machine-executable instructions to perform the various functions described. The one or more processors 200 may include, without limitation, a central processing unit (CPU), a digital signal processor (DSP), a reduced instruction set computer (RISC), a complex instruction set computer (CISC), a System-on-a-Chip (SoC), a microprocessor, a microcontroller, a field programmable gate array (FPGA), or any combination thereof. The dispatch servers 110 may also include a chipset (not shown) for controlling communications between the one or more processors 200 and one or more of the other components of the dispatch servers 110. The one or more processors 200 may also include one or more application specific integrated circuits (ASICs), a System-on-a-Chip (SoC), or application specific standard products (ASSPs) for handling specific data processing functions or tasks. In certain embodiments, the dispatch servers 110 may be based on an Intel® Architecture system and the one or more processors 200 and chipset may be from a family of Intel® processors and chipsets, such as the Intel® Atom® processor family.

The one or more I/O device interfaces 202 may enable the use of one or more (I/O) device(s) or user interface(s), such as a keyboard and/or mouse. The network interfaces(s) 202 may allow the dispatch servers 110 to communicate via the one or more network(s) 160 and/or via other suitable communicative channels. For example, the dispatch servers 110 may be configured to communicate with stored databases, other computing devices or servers, user terminals, or other devices on the networks 160. The storage interface(s) 206 may enable the dispatch servers 110 to store information, such as vehicle identifiers (e.g., identifying credentials, VIN numbers), vehicle type data (e.g., make and/or model of the vehicle, and/or an identification of the vehicle as a commercial vehicle, residential vehicle, farm vehicle, emergency responder, police car, ambulance, fire truck, first responder, or other indicia of an emergency vehicle), vehicle features data (e.g., anti-lock braking systems, active or passive crash-avoidance systems, four-wheel drive, all-wheel drive, dynamic stability, tire type, etc.), traffic signal 115, tollgate and/or traffic control display location data in storage devices.

The memory 210 may include one or more volatile and/or non-volatile memory devices including, but not limited to, magnetic storage devices, read-only memory (ROM), random access memory (RAM), dynamic RAM (DRAM), static RAM (SRAM), synchronous dynamic RAM (SDRAM), double data rate (DDR) SDRAM (DDR-SDRAM), RAMBUS DRAM (RDRAM), flash memory devices, electrically erasable programmable read-only memory (EEPROM), non-volatile RAM (NVRAM), universal serial bus (USB) removable memory, or combinations thereof.

The memory 210 may store program instructions that are loadable and executable on the processor(s) 200, as well as data generated or received during the execution of these programs. Turning to the contents of the memory 210 in more detail, the memory 210 may include one or more operating systems (O/S) 212, an applications module 214, vehicle validation module 216, a routing module 218, a TBIT generator module 220, a road and weather condition module 234, a speed determination module 236, and/or vehicle data 222. Each of the modules, data, and/or software may provide functionality for the dispatch servers 110, when executed by the processors 200. The modules, data, and/or the software may or may not correspond to physical locations and/or addresses in memory 210. In other words, the contents of each of the modules 212, 214, 216, 218, 220, 234, and 236 may not be segregated from each other and may, in fact be stored in at least partially interleaved positions on the memory 210. Further, while the example embodiment in FIG. 2 presents the modules 212, 214, 216, 218, 220, 234, and 236 as being separate, in other example embodiments the operations of these modules may be combined in any manner into fewer than the seven modules presented. For example, the operations of the road and weather condition module 234 and the speed determination module 236 may be combined. In another example, all of the operations of these modules 212, 214, 216, 218, 220, 234, and 236 may be completed by a single module. Any other combination and consolidation of operations of the modules 212, 214, 216, 218, 220, 234, and 236 is contemplated herein.

The O/S module 212 may have one or more operating systems stored thereon. The processors 200 may be configured to access and execute one or more operating systems stored in the (O/S) module 212 to operate the system functions of the dispatch server 110. System functions, as managed by the operating system may include memory management, processor resource management, driver management, application software management, system configuration, and the like. The operating system may be any variety of suitable operating systems including, but not limited to, Google® Android®, Microsoft® Windows®, Microsoft® Windows® Server®, Linux, Apple® OS-X®, or the like.

The application(s) module 214 may contain instructions and/or applications thereon that may be executed by the processors 200 to provide one or more functionality associated with provided expedited access and speed recommendation services to a multitude of emergency vehicles 135 and vehicles 145. These instructions and/or applications may, in certain aspects, interact with the (O/S) module 212 and/or other modules of the dispatch servers 110. The applications module 214 may have instructions, software, and/or code stored thereon that may be launched and/or executed by the processors 200 to execute one or more applications and functionality associated therewith.

The vehicle validation module 216 may have instructions stored thereon that, when executed by the processors 200, enable the dispatch servers 110 to receive identifying credentials and determine if those identifying credentials identify an emergency vehicle 135 that is currently responding to an emergency situation. The vehicle validation module 216 may also have instructions stored thereon that, when executed by the processors 200, enable the dispatch servers 110 to receive vehicle type, feature, and safety information for a multitude of vehicles 145 and/or emergency vehicles 135 and facilitate the storage of that information, and generate or otherwise associated identifying credentials that uniquely identify each of the vehicles 145 and emergency vehicles 135. The vehicle type, feature, and safety information, as well as the identifying credentials, may be stored on the memory 210 and/or other suitable database(s).

The routing module 218 may have instructions stored thereon that, when executed by the processors 200 enable the dispatch servers 110 to receive routing information from one or more emergency communication networks 155 that provide a vehicle route for the emergency vehicle 135 during an emergency situation and determine traffic signals and/or tollgates 115 in the path of the vehicle route that will need to be provisioned with TBITs and identifying credentials of the emergency vehicle 135. The routing module 218 may also have instructions stored thereon that, when executed by the processors 200 enable the dispatch servers 110 to determine the current location of the emergency vehicle 135 and calculate a series of estimated time periods that the emergency vehicle 135 will reach each of the determined traffic signals and/or tollgates 115. The routing module 218 may also have instructions stored thereon that, when executed by the processors 200 enable the dispatch servers 110 to determine a location of a vehicle 135 and/or emergency vehicle based on the location of the traffic control display 125 from which a speed request message is received.

The TBIT generator module 220 may have instructions stored thereon that, when executed by the processors 200 enable the dispatch servers 110 to generate and transmit TBITs to each of the determined traffic signals and/or tollgates along the vehicle route and to generate and transmit the TBIT to the emergency vehicle 135 designated by the identifying credentials received from the emergency communications network 155.

The road and weather condition module 234 may have instructions stored thereon that, when executed by the processors 200, enable the dispatch servers 110 to retrieve road condition, traffic level, and weather condition information from one or more local or third-party intranet or Internet sites for the current location of the vehicle 135 or emergency vehicle 135 making the speed request to the traffic control display 125.

The speed determination module 236 may have instructions stored thereon that, when executed by the processors 200 enable the dispatch servers 110 to determine a recommended speed for a particular vehicle 145 or emergency vehicle 135 in response to receiving a speed request message and transmitting the recommended speed to a traffic control display 125 via the network 160. The speed determination module 236 may facilitate the determination of the recommended speed based on one or more of road conditions, traffic conditions, and weather conditions retrieved by the road and weather condition module 234 and stored vehicle type and vehicle feature data stored in the vehicle data files 222. In addition, the speed determination module 236 may further facilitate the determination of the recommended speed based at least in part on driver credentials (e.g., driver's age, driver's driving record, any special training obtained by the driver related to vehicle driving and control, etc.) for the particular driver of the vehicle.

The vehicle data files or database 222 may include information associated with one or vehicles 145, emergency vehicles 135, traffic signals and tollgates 115, and traffic control displays 125. The vehicle data database 222 may include vehicle identifier files 224 (e.g., identifying credentials and/or VIN numbers) for each vehicle 145 and emergency vehicle 135 registered with the dispatch server 110. The vehicle data database 222 may also include vehicle type files 226, vehicle features files 228, and traffic signal and tollgate location files 230. The vehicle type files 226 may include one or more vehicle type indications (e.g., make and/or model of the vehicle, and/or an identification of the vehicle as a commercial vehicle, residential vehicle, farm vehicle, emergency responder, police car, ambulance, fire truck, first responder, or other indicia of an emergency vehicle) for each vehicle 145 and/or emergency vehicle 135 registered with the dispatch server 110. Each vehicle type file 226 can include or be associated with identifying credentials for a particular emergency vehicle 135 or vehicle 145.

The vehicle features files 228 may include the capabilities and safety features of each vehicle 145 and emergency vehicle 135 registered with the dispatch servers 110. The vehicle features can include, but are not limited to, anti-lock braking systems, active or passive crash-avoidance systems, four-wheel drive, all-wheel drive, dynamic stability, tire type, etc. Each vehicle features file 228 can include or be associated with identifying credentials for a particular emergency vehicle 135 or vehicle 145. The traffic signals and tollgate locations file 230 may include the location of each traffic signal 115, tollgate, and/or traffic control display 125 that is capable of communication and/or receiving instructions from the dispatch server 110.

It will be appreciated that there may be overlap in the functionality of the instructions stored in the operating systems (O/S) module 212, the applications module 214, the vehicle validation module 216, the routing module 218, the TBIT generator module 220, the road and weather condition module 234 and/or the speed determination module 236. In fact, the functions of the aforementioned modules 212, 214, 216, 218, 220, 234, and 236 may interact and cooperate seamlessly under the framework of the dispatch servers 110. Indeed, each of the functions described for any of the modules 212, 214, 216, 218, 220, 234, and 236 may be stored in any module 212, 214, 216, 218, 220, 234, and 236 in accordance with certain example embodiments of the disclosure. Further, in certain embodiments, there may be one single module that includes the instructions, programs, and/or applications described within the operating systems (O/S) module 212, the applications module 214, the vehicle validation module 216, the routing module 218, the TBIT generator module 220, the road and weather condition module 234 and/or the speed determination module 236.

Figure 3:
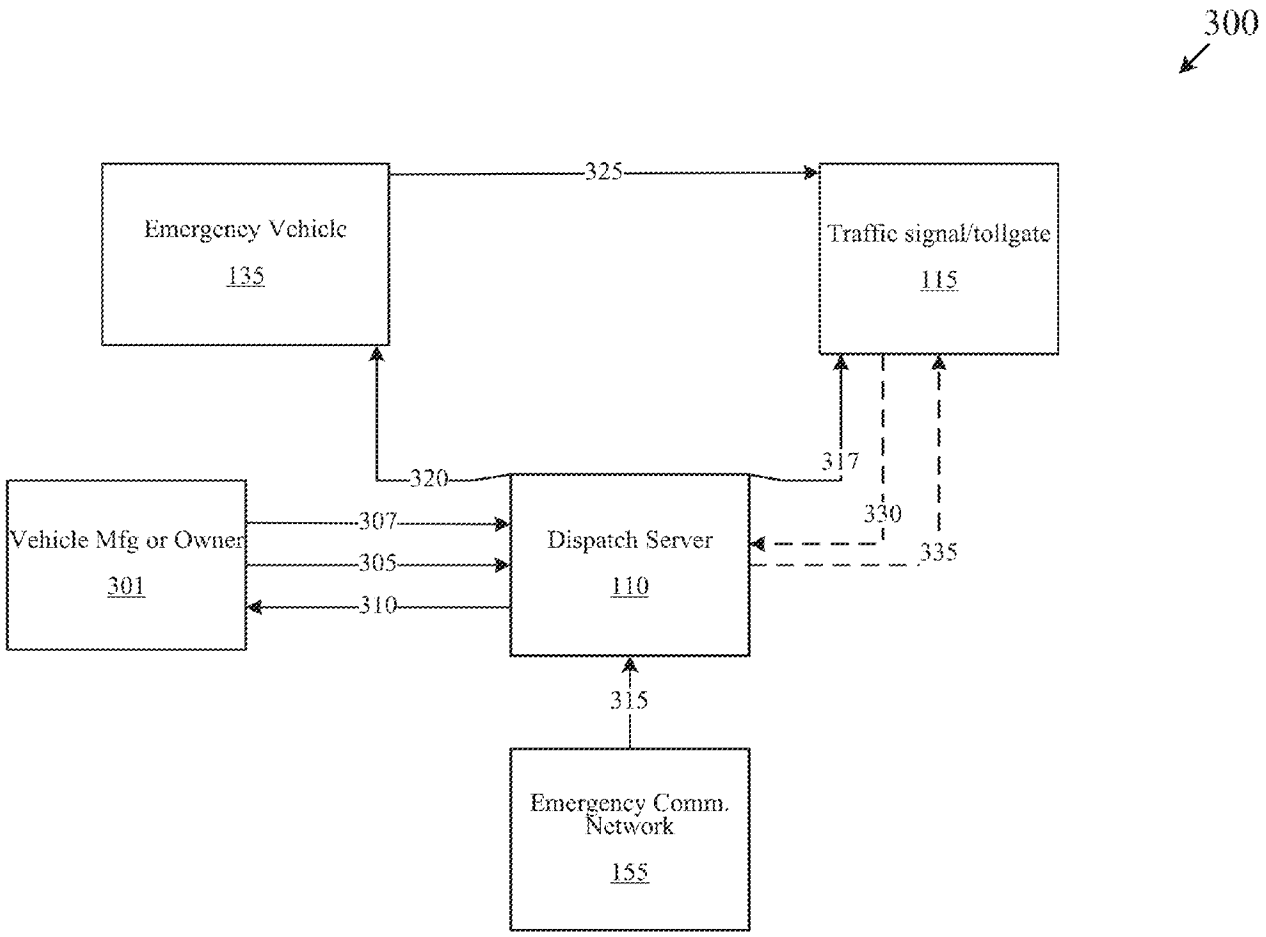
FIG. 3 is an example data flow for real-time emergency vehicle authentication and corresponding management of traffic signals and/or tollgates, in accordance with example embodiments of the disclosure.
Figure 4:
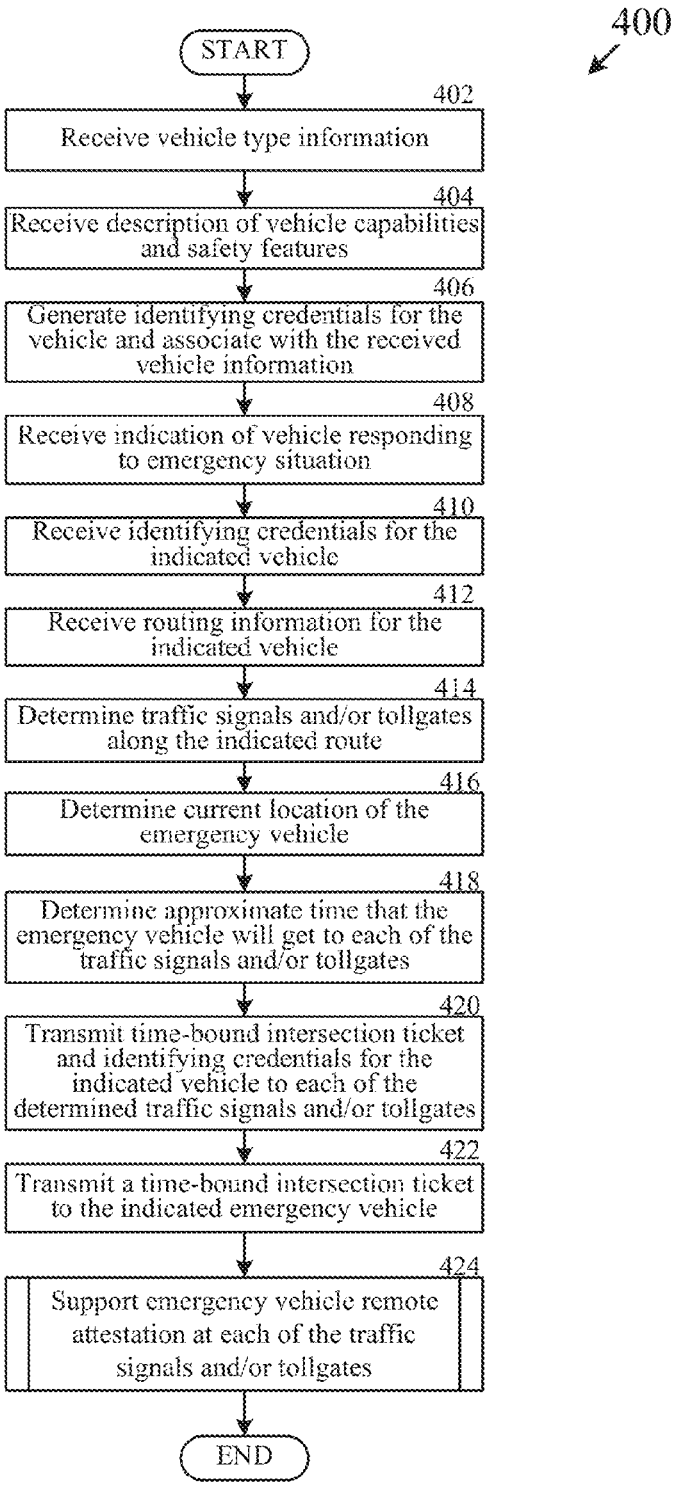
FIG. 4 is a flow chart illustrating an example method for real-time emergency vehicle and traffic signal/tollgate provisioning of data for subsequent authentication, in accordance with example embodiments of the disclosure.

FIG. 3 is an example data flow 300 for real-time emergency vehicle authentication and corresponding management of traffic signals and/or tollgates, in accordance with example embodiments of the disclosure. FIG. 4 is a flow chart illustrating an example method 400 for real-time emergency vehicle and traffic signal/tollgate provisioning of data for subsequent authentication, in accordance with certain example embodiments of the disclosure. All or a portion of the method 400 may be performed by the dispatch server 110 and the processors 200 thereon. Now referring to FIGS. 1-4, the exemplary method 400 begins at the START block and proceeds to block 402, where the dispatch server 110 receives vehicle type information 305 for the emergency vehicle 135. In one example, the vehicle type information 305 can be received from the manufacturer of the emergency vehicle 135 by way of a computerized device via the network 160 at or near the time of manufacture. Alternatively, the vehicle type information 305 can be received from an owner/operator of the vehicle by way of a computerized device via the network 160. Vehicle types can include, but are not limited to, the make and/or model of the vehicle, an identification of the vehicle as a commercial vehicle, residential vehicle, farm vehicle, emergency responder, police car, ambulance, fire truck, first responder, or other indicia of an emergency vehicle. The vehicle type information 305 can be stored by the dispatch server 110 with other vehicle type information 226 in the vehicle data database 222.

At block 404, the dispatch server 110 can receive a description 307 of the capabilities and safety features of the emergency vehicle 135 in a manner substantially the same as that described in block 402. The capabilities and safety features 307 of the vehicle 135 can include, but are not limited to, anti-lock braking systems, active or passive crash-avoidance systems, four-wheel drive, all-wheel drive, dynamic stability, tire type, etc. The description of the capabilities and safety features 307 can be stored by the dispatch server 110 with other vehicle features information 228 in the vehicle data database 222. At block 406, the dispatch server 110 can generate identifying credentials 310 for the emergency vehicle 135 and associate the identifying credentials 310 with the received and stored vehicle type information 305 and capabilities and safety features 307 in the vehicle data database 222. In addition, the identifying credentials 310 can be transmitted to the vehicle manufacture or owner and/or uploaded to the emergency vehicle 135 via the IoT device 140.

At block 408, the dispatch server 110 can receive an indication that an emergency vehicle 135 will be or already is responding to an emergency event. For example, the dispatch server 110 may receive a communication 315 from an emergency communications network 155 via the network 160. In one example, the emergency communications network 155 can be an emergency dispatch service at the local, state, or federal level, including those services connected to the 911 emergency telephone network. Alternatively, the communication 315 could be from the emergency vehicle 135.

In yet another alternative embodiment, an owner (e.g., via phone) of a non-emergency vehicle 145 may provide a communication to the dispatch server 110 seeking to be provisioned with temporary emergency vehicle expedited access rights. In this alternative embodiment, the owner may provide identifying credentials for the non-emergency vehicle 150 as well as the reason for the need for emergency vehicle expedited access rights and the destination location or route the "deputized" vehicle will be going during the emergency event. In this alternative embodiment, the dispatch server 110 can, in response to the request, effectively temporarily deputize the non-emergency vehicle 145 as an emergency vehicle by providing it with the necessary TBITs to receive emergency vehicle expedited access rights and providing corresponding TBITs to traffic signals 115 and tollgates along the identified route.

At block 410, the dispatch server 110 can receive identifying credentials for the emergency vehicle 135 as part of the communication 315 from the emergency communications network 155. At block 412, the dispatch server 110 can also receive routing information for the emergency vehicle to respond to the emergency situation as part of the communication 315 from the emergency communications network 155. In one example, the routing information can provide a detailed, step-by-step street mapping of how the emergency vehicle 135 will get from its current location to its ultimate destination.

At block 414, the dispatch server 110, based at least in part on the received routing information, may determine which traffic signals 115 and/or tollgates the emergency vehicle 135 will need to pass through on the way to its destination. In one example, the determination can be completed by the routing module 318 based at least in part on a comparison of the routing information to stored traffic signal and tollgate location data 230.

At block 416, the dispatch server 110 can determine the current location of the emergency vehicle 135. In one example, the location of the emergency vehicle 135 can be provided in the communication 315. Alternatively, the location of the emergency vehicle 135 can be received by the dispatch server 110 in real-time based on a communication/broadcast by the IoT device 140 of the emergency vehicle 135. At block 418, the dispatch server 110 may determine the approximate time that the emergency vehicle 135 will get to each of the traffic signals and/or tollgates along the identified route. In one example embodiment, the determination may be based at least in part on the current time, the current location of the emergency vehicle 135 and the identified route. In addition, the determination may also be based at least in part on current traffic conditions along the identified route, which may be determined by the dispatch server 110.

At block 420, the dispatch server 110 may generate and transmit a TBIT and the identifying credentials 317 for the emergency vehicle 135 to each of the traffic signals 115 and tollgates determined to be along the received route. The TBIT can include a key for encrypting and decrypting messages sent between the emergency vehicle 135 and the traffic signal/tollgate and can be generated by the TBIT generator module 220 of the dispatch server 110. In one example, the TBIT and identifying credentials can be received by an IoT device 120 associated with each of the traffic signals 115 and/or tollgates. In one example, a lifetime or validity period for each of the TBITs is selected by the dispatch server 110 and programmed into each TBIT so that the particular TBIT is valid at the estimated time that the emergency vehicle 135 is expected to reach the intersection associated with the particular traffic signal 115 or tollgate based on the identified route. In one example, the validity period for each TBIT may range anywhere between 1 second-1 hour. Further, the validity period may be different for each of the TBITs provided for the current emergency situation. For example, the validity period may generally increase from the beginning of the route to the end of the route as other factors, such as traffic conditions, may make estimating the time the emergency vehicle reaches a particular traffic signal more difficult the further along the route the traffic signal is located.

At block 422, the dispatch server 110 may transmit a TBIT 320 to the emergency vehicle 135. The TBIT can include a key for encrypting and decrypting messages sent between the emergency vehicle 135 and the traffic signal/tollgate and can be generated by the TBIT generator module 220 of the dispatch server 110. In one example embodiment, the emergency vehicle 135 may receive the TBIT via the IoT device 140 associated with the vehicle's on-board computer system. At block 424, the dispatch server 110 supports remote attestation of the emergency vehicle 135 at each of the traffic signals 115 and tollgates along the identified route. The support of the remote attestation is described in greater detail in FIG. 5 discussed hereinbelow. The process then proceeds to the END step. While not specifically shown in FIG. 4, any failures that occur during the execution of the procedures outlined in FIG. 4 can be identified by the dispatch server 110 and logged by the dispatch server 110 (e.g., in memory 210) for future analysis and/or improvements to the procedures described in FIG. 4.

Figure 5:
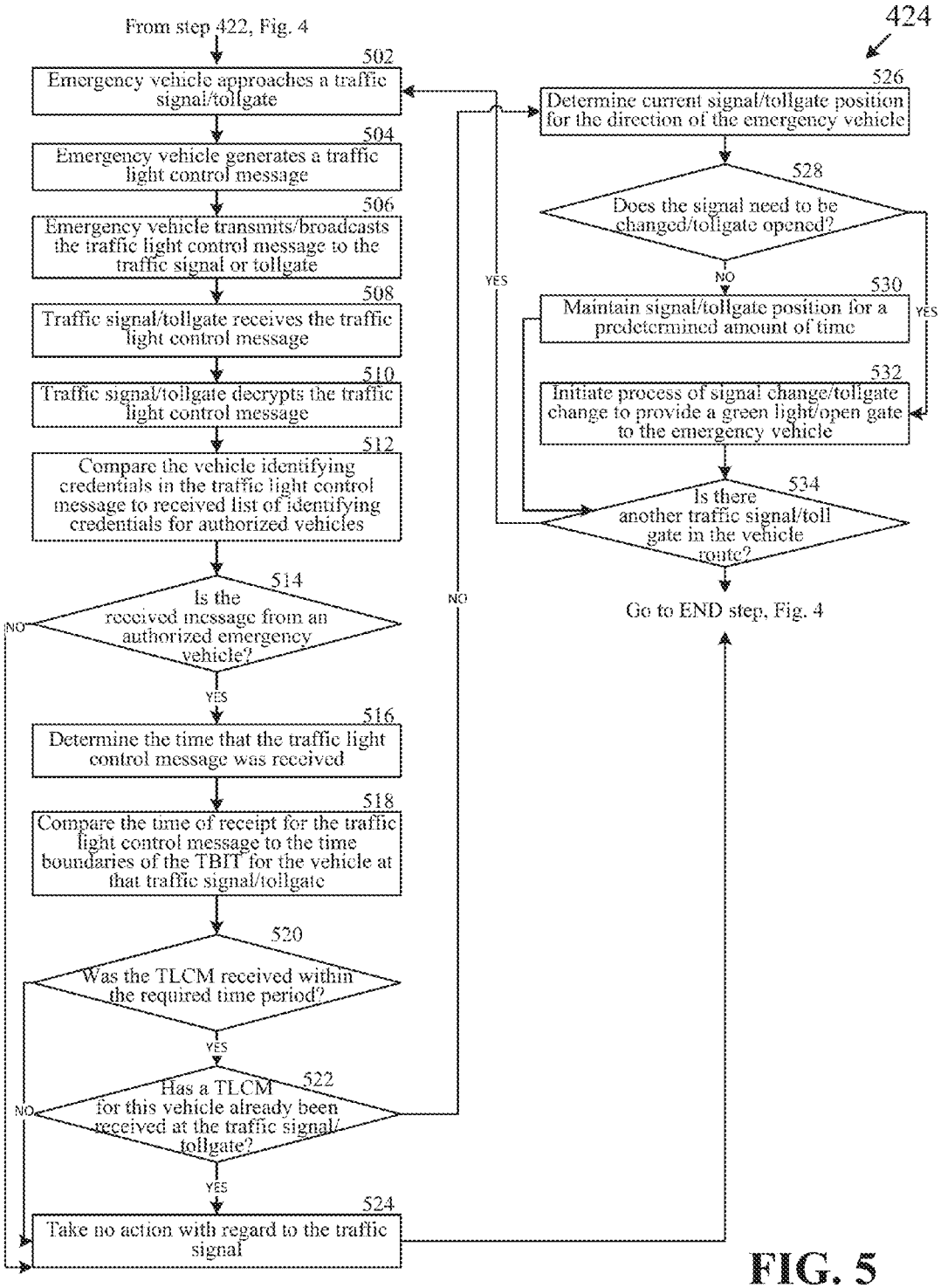
FIG. 5 is a flow chart illustrating an example method for real-time emergency vehicle authentication and corresponding management of traffic signals and/or tollgates, in accordance with example embodiments of the disclosure.

FIG. 5 is a flow chart illustrating an example method 424 for real-time emergency vehicle authentication and corresponding management of traffic signals and/or tollgates, in accordance with example embodiments of the disclosure. Now referring to FIGS. 1-5, the exemplary method 424 begins at block 502, during the emergency situation, the emergency vehicle 135 approaches an intersection of one of the determined traffic signals 115 or tollgates along the identified route. At block 504, the on-board computer of the emergency vehicle 135 generates a traffic light control message 325. In one example, the traffic light control message can have the following structure: struct LightChangeRequest {IOT_LIGHT_IDlight_id; //SpecificIOTIDinagiventrafficlightLIGHT_STATElight_state; //Green,Red,Yellow.}. The traffic light control message or an associated message packet may also include the identifying credentials for the emergency vehicle 135. The on-board computer of the emergency vehicle 135 may then encrypt the message 325 using the key from the TBIT received from the dispatch server 110. While the message 325 is termed a traffic light control message, the message may also provide control request instructions for tollgates and other forms of traffic signals and traffic control displays.

At block 506, the emergency vehicle transmits or otherwise broadcasts the traffic light control message 325 to the traffic signal 115 or tollgate that the vehicle 135 is approaching. In one example embodiment, the traffic light control message 325 is transmitted/broadcast by the IoT device 140 of the emergency vehicle 135. Example techniques for transmitting/broadcasting the traffic light control message 325 include, but are not limited to, WIFI, WIFI-direct, Bluetooth, modulated laser, a radio frequency transmission, an optical transmission, and, near field communication. The traffic light control message 325 may be transmitted/broadcast once or multiple times to ensure that the particular traffic signal/tollgate receives the message.

At block 508, the traffic signal 115 or tollgate receives the encrypted traffic light control message 325. In one example, the message 325 is received via the IoT device 120 communicably coupled to the traffic signal 115 or tollgate. At block 510, a processor for the traffic signal 115 or tollgate may decrypt the traffic light control message 325 using the key received in the TBIT 317 received from the dispatch server 110.

At block 512, the processor for the traffic signal 115 or tollgate can compare the vehicle identifying credentials in the decrypted traffic light control message 325 or sent therewith to the identifying credentials received from the dispatch server 110 (and optionally stored in a local memory of the traffic signal 115 or tollgate to determine if they match. Matching identifying credentials may mean that the emergency vehicle 135 that sent the traffic light control message 325 is authorized to currently receive expedited access through the traffic signal 115 or tollgate as long as other factors are satisfied. At block 514, an inquiry is conducted to determine if traffic light control message 325 was received from an authorized emergency vehicle. As discussed above, the emergency vehicle 325 can be an authorized emergency vehicle if the identifying credentials for the emergency vehicle 325 (provided in or with the traffic light control message 325) matches the identifying credentials received by the traffic signal 115 or tollgate from the dispatch server 110. If the identifying credentials for the emergency vehicle 325 do not match the identifying credentials received by the traffic signal 115 or tollgate from the dispatch server 110, the NO branch is followed to block 524, where the traffic signal 115 or tollgate takes no action. The process then proceeds to the END step in FIG. 4. On the other hand, if the identifying credentials for the emergency vehicle 325 do match the identifying credentials received by the traffic signal 115 or tollgate from the dispatch server 110, then the YES branch is followed to block 516.

At block 516, the processor for the traffic signal or tollgate may determine the time that the traffic light control message 325 was received by the IoT device 120. When the message 325 is received, a time stamp can be generated for the message and stored in local memory for the particular traffic signal 115 or tollgate. At block 518, the processor for the traffic signal 115 or tollgate can compare the time of receipt of the message 325 to the time boundaries of the received TBIT 317 to determine if the time of receipt is within the bounded time period. In addition, in certain example embodiments, the dispatch server 110 may provide an additional grace period (e.g., additional time amount) to the bounded time period in real-time based on the receipt and evaluation of traffic conditions at and near the location of the particular traffic signal 115 or toll gate or along the route of the emergency vehicle 135 as a whole. For example, based on an evaluation of the current traffic conditions near the particular traffic signal 115, the dispatch server 110 may determine that, due to a greater than expected traffic volume or slower than expected traffic speed in that area, an additional three minutes grace period will be added to the bounded time period for that particular TBIT. At block 520, an inquiry is conducted to determine if the traffic light control message 325 was received by the traffic signal 115 or tollgate within the required time boundaries. The determination can be made by the processor of the traffic signal or tollgate. If the traffic light control message 325 was not received within the required time boundaries, the NO branch can be followed to block 524, where the traffic signal 115 or tollgate takes no action. The process then proceeds to the END step in FIG. 4. On the other hand, if the traffic light control message 325 was received within the required time boundaries, then the YES branch can be followed to block 522.

At block 522, an inquiry is conducted to determine if a traffic light control message 325 for this emergency vehicle 135 has previously been received by the particular traffic signal 115 or tollgate. The determination can be made by the processor associated with the particular traffic signal 115 or tollgate. For example, the processor can store the traffic light control message 325 for emergency vehicles that were authenticated and granted expedited access through the traffic signal 115 or tollgate in local memory and can then compare the newly received message to that of the stored messages to determine if a match exists. In one example, the receipt of multiple traffic light control messages 325 for the same emergency vehicle may indicate fraudulent activity (e.g., the prior message was intercepted by a third-party and regenerated for use by the third party). It could also be a result of the emergency vehicle 135 sending multiple messages 325 to ensure that at least one was received by the traffic signal or tollgate. In any event, there is not a need to authorize expedited access more than once for the emergency vehicle 135 at that particular traffic signal 115 or tollgate. If a traffic light control message 325 for the emergency vehicle 135 was previously received and authenticated, then the YES branch is followed to block 524, where the traffic signal 115 or tollgate takes no action. The process then proceeds to the END step in FIG. 4. On the other hand, if traffic light control message 325 has not been previously received and authenticated for the emergency vehicle 135, then the NO branch is followed to block 526.

While the example embodiment above in steps 512-522 has been described as being completed by the processor of the traffic signal 115 or the tollgate, in an alternate example embodiment, the IoT device 120 for the traffic light 115 or tollgate can transmit 330 the traffic light control message 325 to the dispatch server 110 via the network 160 and steps 512-522 can be completed by the vehicle validation module 216 of the dispatch server 110. Once one or more of steps 512-522 are completed, the dispatch server can transmit 335 the results of those steps to the IoT device 120 for the traffic signal 115 or tollgate via the network 160.

At block 526, the processor for the traffic signal or tollgate can determine the current signal or tollgate position for the direction that the emergency vehicle 135 is travelling. In one example, the current signal can be one of green, yellow, flashing yellow, red, stop, or go. At block 528, an inquiry is conducted to determine if the current signal needs to be changed or the tollgate position opened to provide the emergency vehicle 135 expedited access through the traffic signal 115 or tollgate. In one example, the determination is made by the processor of the particular traffic signal 115 or tollgate. For example, if the traffic signal 115 is already green or go in the direction of travel of the emergency vehicle 135, the traffic signal 115 would not need to change and would instead maintain the green light for an additional predetermined amount of time to allow the emergency vehicle 135 to pass through the traffic signal 115. On the other hand, if the traffic signal 115 is red, yellow, flashing yellow or stop in the direction of travel of the emergency vehicle 135, then the processor of the traffic signal 115 will conduct a controlled change of the lights of the traffic signal 115 at the intersection and provide a green light in the direction of the route of the emergency vehicle 135. If the traffic signal does not need to be changed or the tollgate position is already open and does not need to be changed, then the NO branch is followed to block 530, where the processor for the traffic signal 115 or tollgate maintains the current signal or tollgate position for an additional predetermined amount of time to allow the emergency vehicle to pass. In one example embodiment, the additional predetermined amount of time may be stored in local memory and accessible by the processor of the traffic signal 115 or tollgate. In addition, or alternatively, the change of the current signal can be influenced by current position and heading of the emergency vehicle 135 relative to the particular traffic signal 115. For example, the location of the emergency vehicle 135 can be tracked in real time, via GPS technology, and when the emergency vehicle 135 completes its pass through the intersection associated with the particular traffic signal 115, the current signal may begin the process of changing even though the predetermined amount of time has not yet expired. Similar modifications may be employed for the position of the tollgate. The process then proceeds to block 534. Returning to the inquiry of block 528, if the current signal for the traffic signal needs to be changed or the tollgate position for the tollgate needs to be changed, then the YES branch is followed to block 532, where the processor for the traffic signal 115 or tollgate initiates the process of signal change or tollgate position change in a safe manner to provide a green light or open tollgate to the emergency vehicle 135 in its direction of travel.

In step 534, an inquiry is conducted to determine if there is another traffic signal 115 or tollgate in the identified route for the emergency vehicle 135. If there is another traffic signal 115 or tollgate then the YES branch is followed back to block 502. Otherwise, the NO branch is followed back to the END step of FIG. 4. While not specifically shown in FIG. 5, any failures that occur during the execution of the procedures outlined in FIG. 5 can be identified by the dispatch server 110 and logged by the dispatch server 110 (e.g., in memory 210) for future analysis and/or improvements to the procedures described in FIG. 5.

Figure 6:
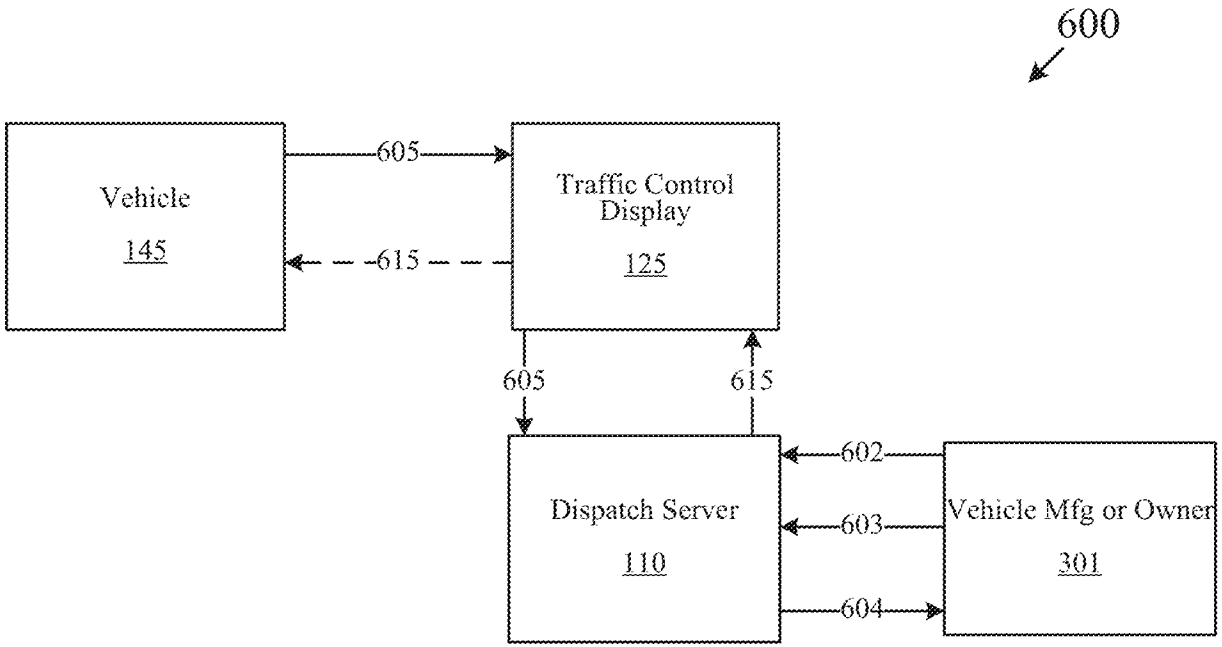
FIG. 6 is an example data flow for generating and displaying speed limit and/or other traffic control information based on vehicle attributes, in accordance with certain example embodiments of the disclosure.
Figure 7:
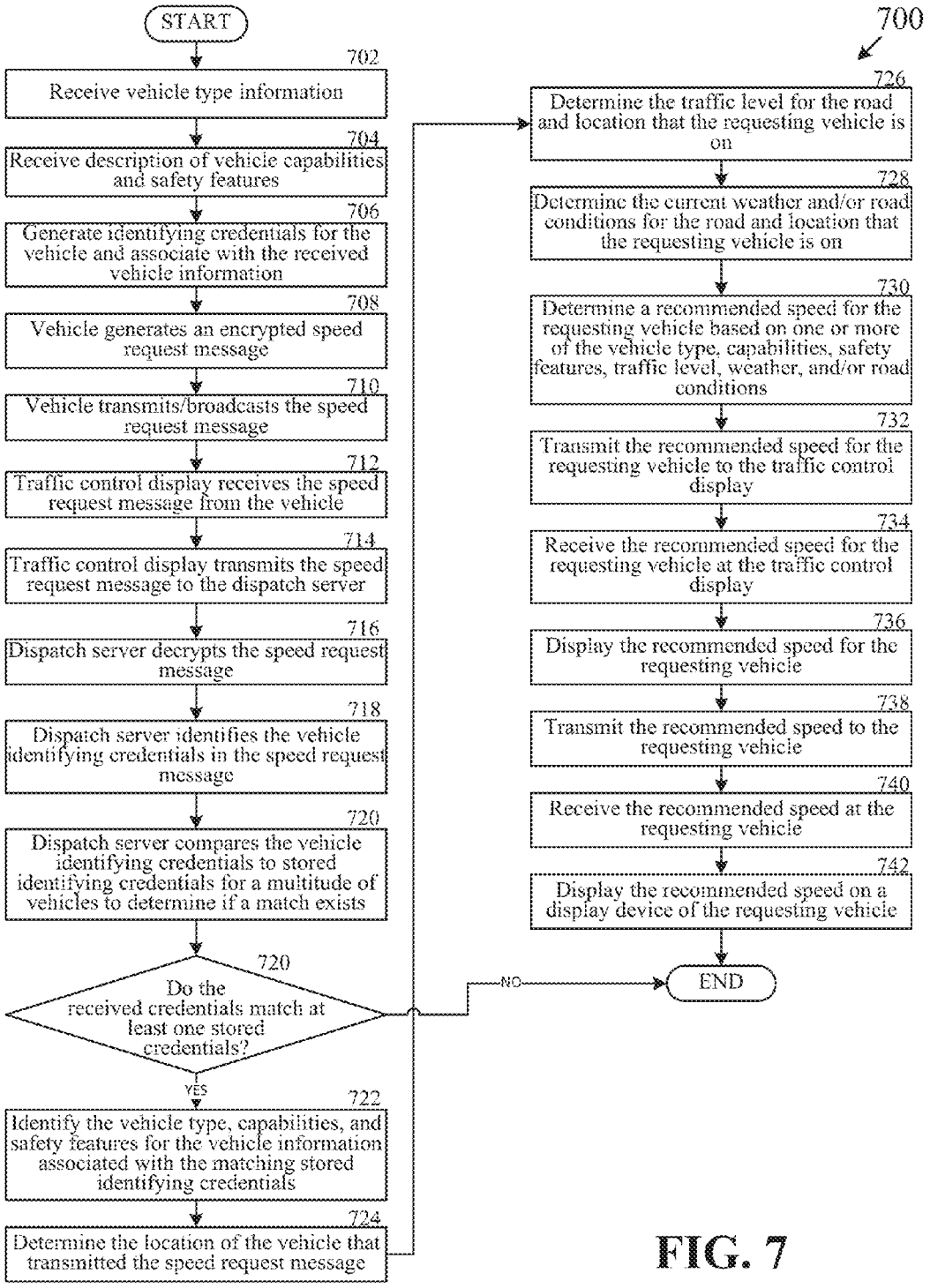
FIG. 7 is a flow chart illustrating an example method for generating and displaying speed limit and/or other traffic control information based on vehicle attributes, in accordance with certain example embodiments of the disclosure.

FIG. 6 is an example data flow 600 for generating and displaying speed limit and/or other traffic control information based on vehicle attributes, in accordance with certain example embodiments of the disclosure. FIG. 7 is a flow chart illustrating an example method 700 for generating and displaying speed limit and/or other traffic control information based on vehicle attributes, in accordance with certain example embodiments of the disclosure. Referring now to FIGS. 1, 2, 6, and 7, the example method 700 begins at the START block and proceeds to block 702, where the dispatch server 110 receives vehicle type information 602 for the vehicle 145. In one example, the vehicle type information 602 can be received from the manufacturer 301 of the vehicle 145 by way of a computerized device via the network 160 at or near the time of manufacture. Alternatively, the vehicle type information 602 can be received from an owner/operator of the vehicle 145 by way of a computerized device via the network 160. Vehicle types can include, but are not limited to, the make and/or model of the vehicle, an identification of the vehicle as a commercial vehicle, residential vehicle, farm vehicle, emergency responder, police car, ambulance, fire truck, first responder, or other indicia of an emergency vehicle. The vehicle type information 602 can be stored by the dispatch server 110 with other vehicle type information 226 in the vehicle data database 222.

At block 704, the dispatch server 110 can receive a description 603 of the capabilities and safety features of the vehicle 145 in a manner substantially the same as that described in block 702. The capabilities and safety features 603 of the vehicle 145 can include, but are not limited to, anti-lock braking systems, active or passive crash-avoidance systems, four-wheel drive, all-wheel drive, dynamic stability, tire type, etc. The description of the capabilities and safety features 603 can be stored by the dispatch server 110 with other vehicle features information 228 in the vehicle data database 222. At block 706, the dispatch server 110 can generate identifying credentials 604 for the vehicle 145 and associate the identifying credentials 604 with the received and stored vehicle type information 602 and capabilities and safety features 603 in the vehicle data database 222. In addition, the identifying credentials 604 can be transmitted to the vehicle manufacture 301 or owner and/or uploaded to the vehicle 145 via the IoT device 145.

At block 708, the vehicle 145 generates an encrypted speed request message 605. In example embodiment, the speed request message 605 can include the identifying credentials 604 for the vehicle 145 and can be generated by the vehicle's on-board computer system. The speed request message 605 can be automatically generated (e.g., a predetermined time or distance intervals) or generated in response to a request by a user of the vehicle (e.g., pressing a request button and speaking a request command). At block 710, the vehicle transmits or otherwise broadcasts the speed request message 605 to a traffic control display 125 (e.g., speed limit sign, dynamic traffic control sign, etc.). In one example embodiment, the speed request message 605 is transmitted/broadcast by the IoT device 150 of the vehicle 145. Example techniques for transmitting/broadcasting the speed request message 605 include, but are not limited to, WIFI, WIFI-direct, Bluetooth, modulated laser, a radio frequency transmission, an optical transmission, and, near field communication. The speed request message 605 may be transmitted/broadcast once or multiple times to ensure that the particular traffic control display receives the message.

At block 712, the traffic control display 125 receives the encrypted speed request message 605. In one example, the message 605 is received via the IoT device 130 communicably coupled to the traffic control display 125. At block 714, the traffic control display 125 transmits the speed request message 605 to the dispatch server 110. In one example, the message 605 is transmitted by the IoT device 130 for the traffic control display 125 to the dispatch server 110 via the network 160.

At block 716, the dispatch server 110 decrypts the speed request message 605 using a key. In one example, the decryption of the speed request message 605 is completed by the speed determination module 236. At block 718, the speed determination module 236 of the dispatch server 110 can identify the vehicle identifying credentials 604 for the vehicle 145 in the speed request message 605. At block 720, the speed determination module 236 of the dispatch server 110 can compare the vehicle identifying credentials 604 for the vehicle making the request 605 to stored identifying credentials for multiple vehicles (such as the stored vehicle identifiers 224 in the vehicle data database 222 to determine if a match exists. At block 720, an inquiry is conducted to determine if the received vehicle identifying credentials 604 match at least one of the stored identifying credentials in, for example, the vehicle data database 222. In one example embodiment, the determination can be made by the speed determination module 236 or the vehicle validation module 216 of the dispatch server 110. If matching identifying credentials are not identified, the NO branch can be followed to the END block. On the other hand, if the vehicle identifying credentials 604 are determined to match at least one of the stored identifying credentials in the database 222, then the YES branch is followed to block 722.

At block 722, the speed determination module 236 of the dispatch server 110 can identify the stored vehicle type, capabilities, and safety features for the matching stored identifying credentials record in the database 222. At block 724, the speed determination module 236 of the dispatch server can determine the current location for the vehicle 145 that transmitted the speed request message 605. For example, the speed determination module 236 can determine the location of the vehicle 145 based on the location of the speed control display 125 from which message 605 was received by the dispatch server 110. This location information for the speed control display 125 can be stored and retrieved from the traffic signal and tollgate locations 230 of the vehicle data database 222. Alternatively, the speed determination module may determine the location of the vehicle 145 based on GPS location information from the IoT device 150 for the vehicle 145. In one example embodiment, the current location of the vehicle 145 can be used to determine on or more of the road the vehicle 145 is currently on, the traffic level/conditions of that road, and the weather conditions in that area of the location.

At block 726, the speed determination module 236 of the dispatch server 110 can determine the traffic level for the road and location that the requesting vehicle 145 is currently travelling on. For example, the dispatch server 110 may access and obtain real-time traffic level and/or traffic speed information from one or more public or private websites or network sources via the network 160. At block 728, the speed determination module 236 of the dispatch server 110 can determine the current weather and/or road conditions for the road and location from which the requesting vehicle 145 transmitted the speed request message 605. In one example, the dispatch server 110 may access and obtain real-time weather and road condition information from one or more public or private websites or network sources via the network 160.

At block 730, the speed determination module 236 of the dispatch server 110 may determine a recommended speed for the vehicle 145 on the road associated with the traffic control display 125. In one example, the recommended speed can be determined based at least in part on or more of the following: vehicle type, vehicle capabilities and safety features, a normal speed limit for the particular road, current traffic level, current weather, and/or current road conditions. For example, a vehicle having anti-lock braking systems may be recommended a higher speed limit than a vehicle that does not have anti-lock brakes. Further, a vehicle that has active crash avoidance systems may be recommended a higher speed limit than a vehicle that has passive crash avoidance systems or no crash avoidance systems at all. Further, when there is a higher (more congested) traffic level, then a lower speed limit may be recommended as compared to times when the traffic level is low for that road. Similarly, when there is rain in the area or the road conditions are wet, then a lower speed limit may be recommended as compared to times when the weather conditions are sunny and clear and/or the road conditions are dry. In addition, the speed determination module 236 may further facilitate the determination of the recommended speed based at least in part on driver credentials (e.g., driver's age, driver's driving record, any special training obtained by the driver related to vehicle driving and control, etc.) for the particular driver of the vehicle 145. Further, combinations of different ones of these factors may further increase or decrease the recommended speed for the requesting vehicle 145.

At block 732, the recommended speed 615 for the vehicle 145 is transmitted from the dispatch server 110 to the speed control display 125. In one example, the recommended speed message may further include or be associated with the identifying credentials for the vehicle 145 making the request. At block 734, the speed control display 125 may receive the recommended speed 615 from the dispatch server. For example, the recommended speed and optionally the identifying credentials for the vehicle 145 may be received by the IoT device 130 for the speed control display 125 from the dispatch server 110 via the network 160. At block 736, the speed control display 125 may display the received recommended speed on a dynamic display of the traffic control display 125. In one example, in addition to the recommended speed, certain additional information (such as the identifying credentials or other identifying information for the vehicle 145) may be displayed simultaneously with the recommended speed to uniquely identify to which vehicle the recommended speed information is being provided.

In addition to the process described above, the system may optionally transmit the recommended speed 615 to the vehicle 145 that originally sent the speed request message 605. In one example, the recommended speed 615 may be transmitted by the IoT device 130 of the speed control display 125 to the IoT device 150 for the vehicle 145 using one or more of WIFI, WIFI-direct, Bluetooth, modulated laser, a radio frequency transmission, an optical transmission, and, near field communication. Alternatively, the recommended speed 615 may be transmitted by the dispatch server 110 to the IoT device 150 of the vehicle 145 via the network 160. At block 740, the IoT device 150 of the vehicle can receive the recommended speed 615 and can pass the recommended speed to the on-board computer of the vehicle 145. At block 742, the vehicle 145 can display the recommended speed on a display device of the vehicle 145. The display device can include a head-up display along the windshield of the vehicle 145, the instrumentation panel display, the console display and/or navigation system, and/or any other display device in the vehicle 145 and communicably coupled thereto. The process then continues to the END block. While not specifically shown in FIG. 7, any failures that occur during the execution of the procedures outlined in FIG. 7 can be identified by the dispatch server 110 and logged by the dispatch server 110 (e.g., in memory 210) for future analysis and/or improvements to the procedures described in FIG. 7.

Figure 8:
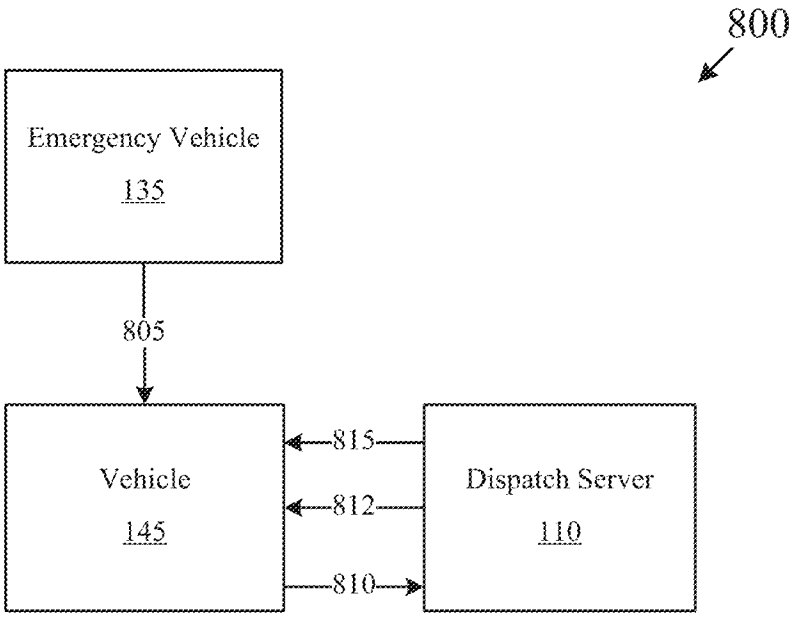
FIG. 8 is an example data flow for determining vehicle relocation based on receipt of an emergency vehicle notification during an emergency situation, in accordance with certain example embodiments of the disclosure.
Figure 9:
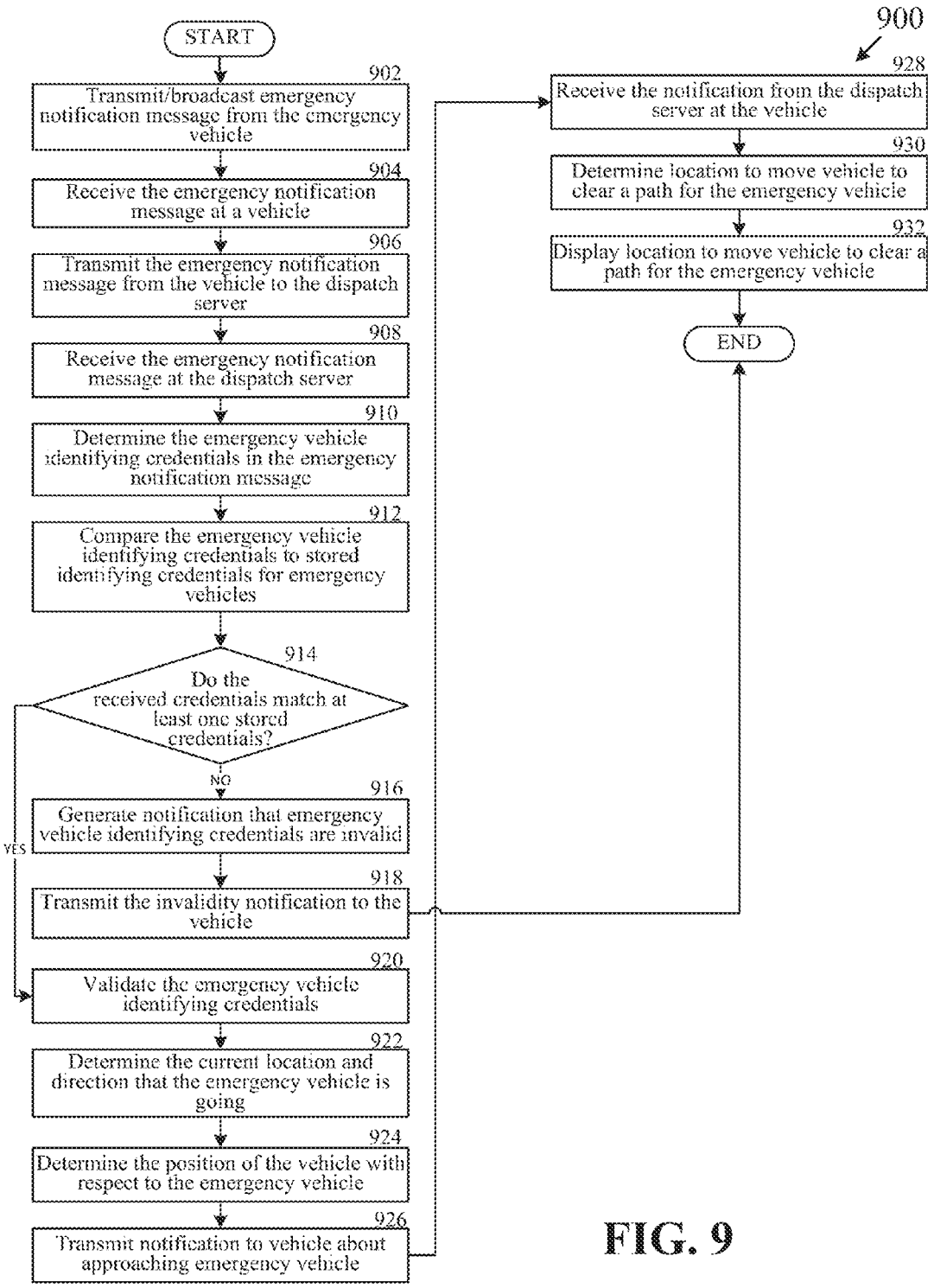
FIG. 9 is a flow chart illustrating an example method for emergency vehicle verification and determination of vehicle location based on receipt of an emergency vehicle notification, in accordance with certain example embodiments of the disclosure.
Figure 10:
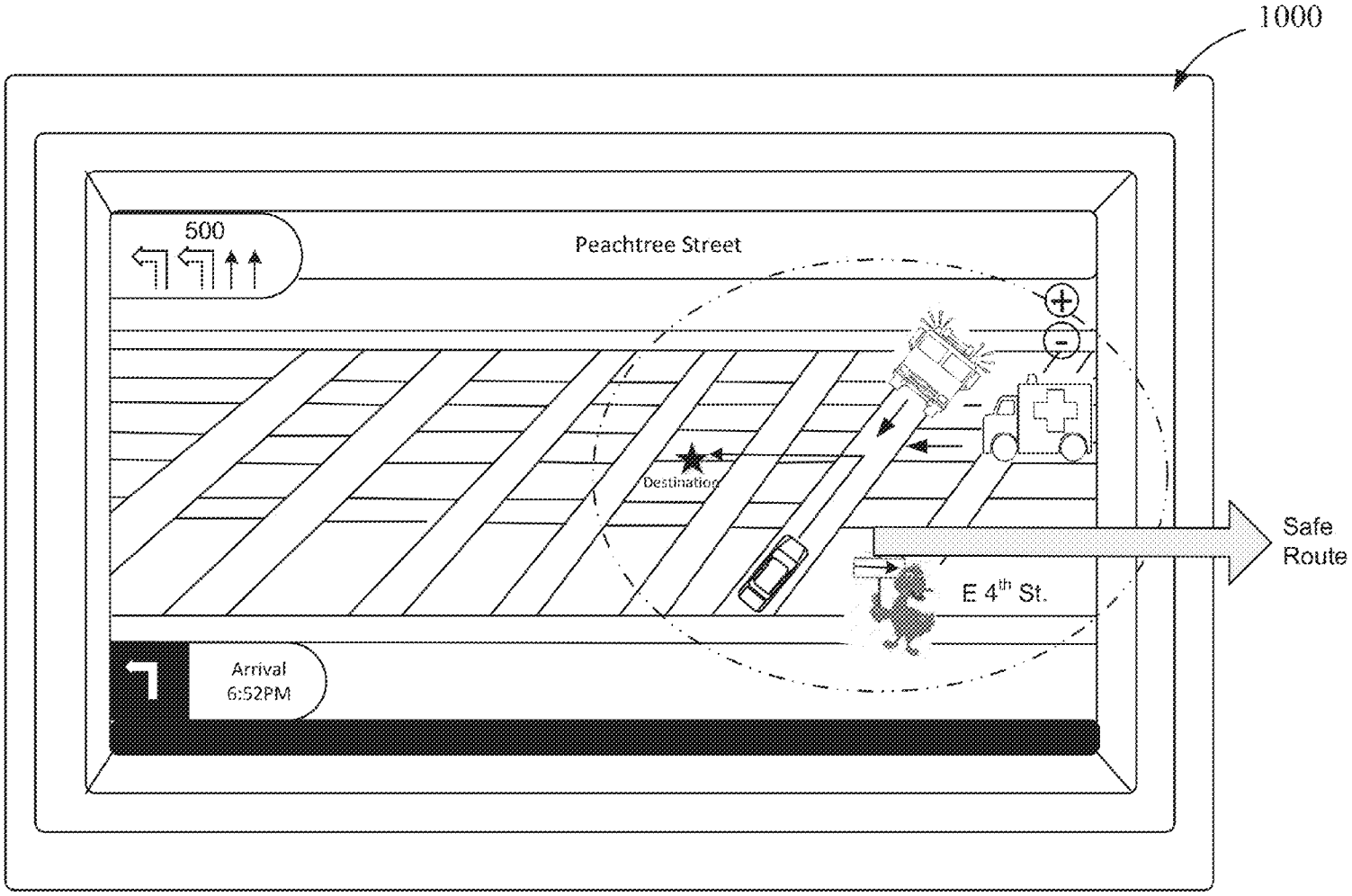
FIG. 10 is an example relocation notification, in accordance with certain example embodiments of the disclosure.

FIG. 8 is an example data flow 800 for determining vehicle relocation based on receipt of an emergency vehicle notification during an emergency situation, in accordance with certain example embodiments of the disclosure. FIG. 9 is a flow chart illustrating an example method 900 for emergency vehicle verification and determination of vehicle location based on receipt of an emergency vehicle notification, in accordance with certain example embodiments of the disclosure. FIG. 10 is an example relocation notification 1000 for display to a user of the vehicle 145, in accordance with certain example embodiments of the disclosure. Referring now to FIGS. 1, 2, and 8-10, the example method 900 begins and the START block and proceeds to block 902, where the emergency vehicle 135 transmits or otherwise broadcasts an emergency notification message 805. In one example, the emergency notification message 805 includes the identifying credentials for the emergency vehicle 135. In addition, the message 805 can include the location of the emergency vehicle 135 and the direction the emergency vehicle is going. In one example, the message 805 can be transmitted or otherwise broadcast by the IoT device 140 of the emergency vehicle and can be transmitted/broadcast via WIFI, WIFI-direct, Bluetooth, modulated laser, a radio frequency transmission, an optical transmission, and, near field communication.

At block 904, one or more vehicles 145 may receive the emergency notification message via the IoT device 150 associated with the vehicle 145. Typically, those vehicles receiving the message will be vehicles in the near-vicinity of the emergency vehicle 145. The radius range of the broadcast of the message will typically be less than one-mile from the emergency vehicle 145. At block 906, the on-board computer for the vehicle 145 can transmit, by way of the IoT device 150, the emergency notification message 805 to the dispatch server 110 via the network 160. At block 908, the dispatch server 110 can receive the emergency notification message 805. In one example embodiment, the emergency notification message 805 can be encrypted and can be decrypted by the dispatch server 110.

At block 910, the vehicle validation module 216 of the dispatch server 110 can determine the identifying credentials in the emergency notification message 805 for the emergency vehicle 135. At block 912, the vehicle validation module 216 of the dispatch server 110 can compare the identifying credentials from the message 805 to stored identifying credentials for emergency vehicles in, for example, the vehicle identifiers section 224 of the vehicle data database 222 to determine if any of the stored credentials match the credentials from the message. In one example embodiment, the stored credentials for emergency vehicles that are currently responding to an emergency situation can be flagged or a separate list of identifying credentials for emergency vehicles currently responding to an emergency situation can be continually updated. The comparison of block 912 can be made only against the identifying credentials for those emergency vehicles that are currently responding to an emergency situation.

At block 914, an inquiry is conducted to determine if at least one of the stored identifying credentials match the identifying credentials from the emergency notification message 805. In one example, the determination can be made by the vehicle validation module 216 of the dispatch computer 110. If a match does not exist, the NO branch is followed to block 916, where the dispatch server 110 generates a notification that the emergency vehicle identifying credentials are invalid. The invalid credentials notification 812 can then be transmitted from the dispatch server 110 to the vehicle 145 and received at the vehicle by the IoT device 150. The process can then proceed to the END block.

Returning to the inquiry of block 914, if at least one of the stored identifying credentials does match the identifying credentials received in the emergency notification message 805, then the YES branch is followed to block 920. At block 920, the vehicle validation module 216 can validate that the identifying credentials for the emergency vehicle 135 are correct (e.g., it is an emergency vehicle and it is currently responding to an emergency situation).

At block 922, the dispatch server may determine the current location and direction that the emergency vehicle 135 is travelling. In one example, the location of the emergency vehicle 135 and the direction it is travelling can be provided in the emergency notification message 805 and parsed from the message 805 by the dispatch server 110. Alternatively, the location of the emergency vehicle 135 can be received by the dispatch server 110 in real-time based on a communication/broadcast by the IoT device 140 of the emergency vehicle 135. Further, the direction the emergency vehicle 135 is travelling can be retrieved based on the routing information received from the emergency communications network 155 as discussed with reference to FIG. 4. At block 924, the routing module 218 of the dispatch computer 110 can determine and compare the current position of the vehicle 145 with regard to the current position of the emergency vehicle 135. In one example, the current position of the vehicle 145 can be received by the dispatch server 110 in real-time based on a communication/broadcast by the IoT device 150 of the emergency vehicle 145.

At block 926, the dispatch server 110 can generate an approaching emergency vehicle notification 815 and can transmit the notification 815 to the IoT device 150 of the vehicle 145 via the network 160. In one example embodiment, the notification 815 can include a map that includes the current position of the vehicle 145, the current position of the emergency vehicle 135, and the route of the emergency vehicle 135. The notification 815 can be received by the IoT device 150 of the vehicle 145 at block 928. At block 930, the vehicle's on-board computer, can determine a location to move the vehicle 145 to clear a path or otherwise avoid the emergency vehicle. In one example, the determination of the location is based at least in part on one or more of the current position of the vehicle 145, the current position of the emergency vehicle 135 and/or the route of the emergency vehicle 135. Further, the determination of the location may also be based at least in part on one or more of the, the destination for the vehicle 135 (e.g., from vehicle's navigation system), one or more vehicle cameras coupled to the vehicle 145 and identifying areas where other vehicles are or are not adjacent to the vehicle 145, and the relative position of other vehicles to the vehicle 145. At block 932, a display of where to move the vehicle 145 can be generated and displayed on a display device of the vehicle (e.g., a heads-up display along the windshield, a console display, and/or the vehicle's navigation computer). One example display 1000 is provided in FIG. 10. The process then proceeds to the END block. While not specifically shown in FIG. 9, any failures that occur during the execution of the procedures outlined in FIG. 9 can be identified by the dispatch server 110 and logged by the dispatch server 110 (e.g., in memory 210) for future analysis and/or improvements to the procedures described in FIG. 9.

Embodiments described herein may be implemented using hardware, software, and/or firmware, for example, to perform the methods and/or operations described herein. Certain embodiments described herein may be provided as one or more tangible machine-readable media storing machine-executable instructions that, if executed by a machine, cause the machine to perform the methods and/or operations described herein. The tangible machine-readable media may include, but is not limited to, any type of disk including floppy disks, optical disks, compact disk read-only memories (CD-ROMs), compact disk rewritable (CD-RWs), and magneto-optical disks, semiconductor devices such as read-only memories (ROMs), random access memories (RAMs) such as dynamic and static RAMs, erasable programmable read-only memories (EPROMs), electrically erasable programmable read-only memories (EEPROMs), flash memories, magnetic or optical cards, or any type of tangible media suitable for storing electronic instructions. The machine may include any suitable processing or computing platform, device or system and may be implemented using any suitable combination of hardware and/or software. The instructions may include any suitable type of code and may be implemented using any suitable programming language. In other embodiments, machine-executable instructions for performing the methods and/or operations described herein may be embodied in firmware. Additionally, in certain embodiments, a special-purpose computer or a particular machine may be formed in order to identify actuated input elements and process the identifications.

Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Other modifications, variations, and alternatives are also possible. Accordingly, the claims are intended to cover all such equivalents.

While certain embodiments of the invention have been described in connection with what is presently considered to be the most practical and various embodiments, it is to be understood that the invention is not to be limited to the disclosed embodiments, but on the contrary, is intended to cover various modifications and equivalent arrangements included within the scope of the claims. Although specific terms are employed herein, they are used in a generic and descriptive sense only, and not for purposes of limitation.

This written description uses examples to disclose certain example embodiments, including the best mode, and also to enable any person skilled in the art to practice certain embodiments of the invention, including making and using any devices or systems and performing any incorporated methods. The patentable scope of certain embodiments of the invention is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

In example embodiments of the disclosure, there may be a non-transitory computer-readable medium storing computer-executable instructions which, when executed by a processor, cause the processor to perform operations. The operations may include receiving, from an emergency communications network, an identifying credential for an emergency vehicle. The operations may include receiving, from the emergency communications network, routing information for the emergency vehicle, wherein the routing information indicates a route the emergency vehicle will proceed in. The operations may include determining one or more traffic signals the emergency vehicle will pass through in the received route. The operations may include generating one or more traffic signal time-bounded intersection tickets, wherein one traffic signal time-bounded intersection ticket may be generated for each of the one or more traffic signals the emergency vehicle will pass through and wherein each traffic signal time-bounded intersection ticket may include a predetermined valid time period. The operations may include generating an emergency vehicle time-bounded intersection ticket. The operations may include transmitting each of the one or more traffic signal time-bounded intersection tickets to the corresponding one or more traffic signals the emergency vehicle will pass through. The operations may include transmitting the identifying credential for the emergency vehicle to the one or more traffic signals the emergency vehicle will pass through. The operations may include transmitting the emergency vehicle time-bounded intersection ticket to the emergency vehicle. The operations may further include determining one or more tollgates the emergency vehicle will pass through in the received route. The operations may further include generating one or more tollgate time-bounded intersection tickets, wherein one tollgate time-bounded intersection ticket may be generated for each of the one or more tollgates the emergency vehicle will pass through and wherein each tollgate time-bounded intersection ticket may include a corresponding predetermined valid time period. The operations may further include transmitting each of the one or more tollgate time-bounded intersection tickets to the corresponding one or more tollgates the emergency vehicle will pass through. The operations may further include transmitting the identifying credential for the emergency vehicle to the one or more tollgates the emergency vehicle will pass through. The operations may further include determining a current location of the emergency vehicle. The operations may further include determining a location for each of the one or more traffic signals that the emergency vehicle will pass through in the received route. The operations may further include comparing the current location of the emergency vehicle to the location for each of the one or more traffic signals that the emergency vehicle will pass through in the received route. The operations may further include determining, based at least in part on the comparison, an estimated time range that the emergency vehicle will get to each of the locations for each of the one or more traffic signals that the emergency vehicle will pass through in the received route, wherein the predetermined valid time period for each of the one or more traffic signal time-bounded intersection tickets may be based at least in part on the determined estimated time range for the corresponding one or more traffic signals. The operations may further include receiving a vehicle type description for the emergency vehicle. The operations may further include generating the identifying credential for the emergency vehicle. The operations may further include transmitting, the identifying credential for storage at the emergency vehicle.

In example embodiments of the disclosure, there may be a non-transitory computer-readable medium storing computer-executable instructions which, when executed by a processor, cause the processor to perform operations. The operations may include receiving, from a dispatch server, a time-bounded intersection ticket, wherein the time-bounded intersection ticket may include a predetermined valid time period. The operations may include receiving, from the dispatch server, a first identifying credential for an emergency vehicle. The operations may include receiving, from the emergency vehicle, an encrypted traffic light control message. The operations may include decrypting the traffic light control message with a key associated with the time-bounded intersection ticket. The operations may include determining, based at least in part on an evaluation of the contents of the traffic light control message, if the traffic light control message may be a valid request to provide expedited access at a traffic signal for the emergency vehicle. With regard to determining if the traffic light control message may be a valid request to provide expedited access at a traffic signal or tollgate for the emergency vehicle, the operations may further include identifying a second identifying credential for the emergency vehicle in the traffic light control message; comparing the first identifying credential to the second identifying credential to determine if the first identifying credential matches the second identifying credential; determining a time of receipt of the traffic light control message; comparing the time of receipt to the predetermined valid time period of the time-bounded intersection ticket to determine if the time of receipt may be within the predetermined valid time period; and determining, based at least in part on the first identifying credential matching the second identifying credential and the time of receipt being within the predetermined valid time period, that the traffic light control message may be the valid request to provide expedited access at the traffic signal for the emergency vehicle. With regard to determining if the traffic light control message may be a valid request to provide expedited access at a traffic signal or tollgate for the emergency vehicle, the operations may further include determining if a second traffic light control message includes the second identifying credential for the emergency vehicle was received prior to the receipt of the traffic light control message from the emergency vehicle, wherein determining that the traffic light control message may be the valid request may be further based at least in part on the determination that the second traffic light control message includes the second identifying credential for the emergency vehicle was not received prior to the receipt of the traffic light control message. The operations may further include determining a current signal displayed at the traffic signal, and determining, based at least in part on the current signal, if the current signal needs to be changed at the traffic signal. The operations may further include initiating a change sequence at the traffic signal based on a positive determination that the current signal needs to be changed. The operations may further include maintaining the current signal for an additional predetermined amount of time based on a negative determination that the current signal needs to be changed.

In example embodiments of the disclosure, there may be a system. The system may include at least one memory that store computer-executable instructions, and at least one processor configured to access the at least one memory. The at least one processor may be configured to execute the computer-executable instructions to receive, from an emergency communications network, an identifying credential for an emergency vehicle. The at least one processor may be configured to execute the computer-executable instructions to receive, from the emergency communications network, routing information for the emergency vehicle, wherein the routing information indicates a route the emergency vehicle will proceed in. The at least one processor may be configured to execute the computer-executable instructions to determine one or more traffic signals the emergency vehicle will pass through in the received route. The at least one processor may be configured to execute the computer-executable instructions to generate one or more traffic signal time-bounded intersection tickets, wherein one traffic signal time-bounded intersection ticket may be generated for each of the one or more traffic signals the emergency vehicle will pass through and wherein each traffic signal time-bounded intersection ticket may include a predetermined valid time period. The at least one processor may be configured to execute the computer-executable instructions to generate an emergency vehicle time-bounded intersection ticket. The at least one processor may be configured to execute the computer-executable instructions to direct communication of each of the one or more traffic signal time-bounded intersection tickets to the corresponding one or more traffic signals the emergency vehicle will pass through. The at least one processor may be configured to execute the computer-executable instructions to direct communication of the identifying credential for the emergency vehicle to the one or more traffic signals the emergency vehicle will pass through. The at least one processor may be configured to execute the computer-executable instructions to direct communication of the emergency vehicle time-bounded intersection ticket to the emergency vehicle. The at least one processor may be further configured to execute the computer-executable instructions to determine one or more tollgates the emergency vehicle will pass through in the received route; generate one or more tollgate time-bounded intersection tickets, wherein one tollgate time-bounded intersection ticket may be generated for each of the one or more tollgates the emergency vehicle will pass through and wherein each tollgate time-bounded intersection ticket may include a corresponding predetermined valid time period; direct communication of each of the one or more tollgate time-bounded intersection tickets to the corresponding one or more tollgates the emergency vehicle will pass through; and direct communication of the identifying credential for the emergency vehicle to the one or more tollgates the emergency vehicle will pass through. The at least one processor may be further configured to execute the computer-executable instructions to determine a current location of the emergency vehicle; determine a location for each of the one or more traffic signals that the emergency vehicle will pass through in the received route; compare the current location of the emergency vehicle to the location for each of the one or more traffic signals that the emergency vehicle will pass through in the received route; and determine, based at least in part on the comparison, an estimated time range that the emergency vehicle will get to each of the locations for each of the one or more traffic signals that the emergency vehicle will pass through in the received route, wherein the predetermined valid time period for each of the one or more traffic signal time-bounded intersection tickets may be based at least in part on the determined estimated time range for the corresponding one or more traffic signals. The at least one processor may be further configured to execute the computer-executable instructions to receive a vehicle type description for the emergency vehicle; generate the identifying credential for the emergency vehicle; and direct communication of the identifying credential for storage at the emergency vehicle.

In example embodiments of the disclosure, there may be a system. The system may include at least one memory that store computer-executable instructions, and at least one processor configured to access the at least one memory. The at least one processor may be configured to execute the computer-executable instructions to receive, from a dispatch server, a time-bounded intersection ticket, wherein the time-bounded intersection ticket may include a predetermined valid time period. The at least one processor may be configured to execute the computer-executable instructions to receive, from the dispatch server, a first identifying credential for an emergency vehicle. The at least one processor may be configured to execute the computer-executable instructions to receive, from the emergency vehicle, an encrypted traffic light control message. The at least one processor may be configured to execute the computer-executable instructions to decrypt the traffic light control message with a key associated with the time-bounded intersection ticket. The at least one processor may be configured to execute the computer-executable instructions to determine, based at least in part on an evaluation of contents of the traffic light control message if the traffic light control message may be a valid request to provide expedited access at a traffic signal for the emergency vehicle. With regard to determining if the traffic light control message may be a valid request to provide expedited access at a traffic signal or tollgate for the emergency vehicle, the at least one processor may be further configured to execute the computer-executable instructions to identify a second identifying credential for the emergency vehicle in the traffic light control message; compare the first identifying credential to the second identifying credential to determine if the first identifying credential matches the second identifying credential; determine a time of receipt of the traffic light control message; compare the time of receipt to the predetermined valid time period of the time-bounded intersection ticket to determine if the time of receipt may be within the predetermined valid time period; and determine, based at least in part on the first identifying credential matching the second identifying credential and the time of receipt being within the predetermined valid time period, that the traffic light control message may be the valid request to provide expedited access at the traffic signal for the emergency vehicle. The at least one processor may be further configured to determine if the traffic light control message may be a valid request to provide expedited access at a traffic signal or tollgate for the emergency vehicle by executing the computer-executable instructions to determine if a second traffic light control message includes the second identifying credential for the emergency vehicle was received prior to the receipt of the traffic light control message from the emergency vehicle, wherein determining that the traffic light control message may be the valid request may be further based at least in part on the determination that the second traffic light control message includes the second identifying credential for the emergency vehicle was not received prior to the receipt of the traffic light control message. The at least one processor may be further configured to execute the computer-executable instructions to determine a current signal displayed at the traffic signal, and determine, based at least in part on the current signal, if the current signal needs to be changed at the traffic signal. The at least one processor may be further configured to execute the computer-executable instructions to initiate a change sequence at the traffic signal to change the current signal to a second signal based on a positive determination that the current signal needs to be changed. The at least one processor may be further configured to execute the computer-executable instructions to execute the computer-executable instructions to maintain the current signal for an additional predetermined amount of time based on a negative determination that the current signal needs to be changed.

In example embodiments of the disclosure, there may be a computer-implemented method. The computer-implemented method may include receiving, by a dispatch server comprising one or more processors from an emergency communications network, an identifying credential for an emergency vehicle. The computer-implemented method may include receiving, by the dispatch server from the emergency communications network, routing information for the emergency vehicle, wherein the routing information indicates a route the emergency vehicle will proceed in. The computer-implemented method may include determining, by the dispatch server, one or more traffic signals the emergency vehicle will pass through in the received route. The computer-implemented method may include generating, by the dispatch server, one or more traffic signal time-bounded intersection tickets, wherein one traffic signal time-bounded intersection ticket may be generated for each of the one or more traffic signals the emergency vehicle will pass through and wherein each traffic signal time-bounded intersection ticket may include a predetermined valid time period. The computer-implemented method may include generating, by the dispatch server, an emergency vehicle time-bounded intersection ticket. The computer-implemented method may include transmitting, by the dispatch server, each of the one or more traffic signal time-bounded intersection tickets to the corresponding one or more traffic signals the emergency vehicle will pass through. The computer-implemented method may include transmitting, by the dispatch server, the identifying credential for the emergency vehicle to the one or more traffic signals the emergency vehicle will pass through. The computer-implemented method may include transmitting, by the dispatch server, the emergency vehicle time-bounded intersection ticket to the emergency vehicle. The computer-implemented method may further include determining, by the dispatch server, one or more tollgates the emergency vehicle will pass through in the received route; generating, by the dispatch server, one or more tollgate time-bounded intersection tickets, wherein one tollgate time-bounded intersection ticket may be generated for each of the one or more tollgates the emergency vehicle will pass through and wherein each tollgate time-bounded intersection ticket may include a corresponding predetermined valid time period; transmitting, by the dispatch server, each of the one or more tollgate time-bounded intersection tickets to the corresponding one or more tollgates the emergency vehicle will pass through; and transmitting, by the dispatch server, the identifying credential for the emergency vehicle to the one or more tollgates the emergency vehicle will pass through. The computer-implemented method may further include determining, by the dispatch server, a current location of the emergency vehicle; determining, by the dispatch server, a location for each of the one or more traffic signals that the emergency vehicle will pass through in the received route; comparing, by the dispatch server, the current location of the emergency vehicle to the location for each of the one or more traffic signals that the emergency vehicle will pass through in the received route; and determining, by the dispatch server and based at least in part on the comparison, an estimated time range that the emergency vehicle will get to each of the locations for each of the one or more traffic signals that the emergency vehicle will pass through in the received route, wherein the predetermined valid time period for each of the one or more traffic signal time-bounded intersection tickets may be based at least in part on the determined estimated time range for the corresponding one or more traffic signals. The computer-implemented method may further include receiving, by the dispatch server, a vehicle type description for the emergency vehicle; generating, by the dispatch server, the identifying credential for the emergency vehicle; and transmitting, by the dispatch server, the identifying credential for storage at the emergency vehicle.

In example embodiments of the disclosure, there may be an apparatus. The apparatus may include at least one memory that stores computer-executable instructions and at least one processor configured to access the at least one memory and to execute the computer-executable instructions. The one or more processors may be configured to execute the computer-executable instructions to receive an identifying credential for an emergency vehicle. The one or more processors may be configured to execute the computer-executable instructions to receive routing information for the emergency vehicle, wherein the routing information indicates a route the emergency vehicle will proceed in. The one or more processors may be configured to execute the computer-executable instructions to determine one or more traffic signals the emergency vehicle will pass through in the received route. The one or more processors may be configured to execute the computer-executable instructions to generate one or more traffic signal time-bounded intersection tickets, wherein one traffic signal time-bounded intersection ticket may be generated for each of the one or more traffic signals the emergency vehicle will pass through and wherein each traffic signal time-bounded intersection ticket may include a predetermined valid time period. The one or more processors may be configured to execute the computer-executable instructions to generate an emergency vehicle time-bounded intersection ticket. The one or more processors may be configured to execute the computer-executable instructions to transmit each of the one or more traffic signal time-bounded intersection tickets to the corresponding one or more traffic signals the emergency vehicle will pass through. The one or more processors may be configured to execute the computer-executable instructions to transmit the identifying credential for the emergency vehicle to the one or more traffic signals the emergency vehicle will pass through. The one or more processors may be configured to execute the computer-executable instructions to transmit the emergency vehicle time-bounded intersection ticket to the emergency vehicle. The one or more processors may be further configured to execute the computer-executable instructions to determine one or more tollgates the emergency vehicle will pass through in the received route. The one or more processors may be further configured to execute the computer-executable instructions to generate one or more tollgate time-bounded intersection tickets, wherein one tollgate time-bounded intersection ticket may be generated for each of the one or more tollgates the emergency vehicle will pass through and wherein each tollgate time-bounded intersection ticket may include a corresponding predetermined valid time period. The one or more processors may be further configured to execute the computer-executable instructions to transmit each of the one or more tollgate time-bounded intersection tickets to the corresponding one or more tollgates the emergency vehicle will pass through. The one or more processors may be further configured to execute the computer-executable instructions to transmit the identifying credential for the emergency vehicle to the one or more tollgates the emergency vehicle will pass through. The one or more processors may be further configured to execute the computer-executable instructions to determine a current location of the emergency vehicle. The one or more processors may be further configured to execute the computer-executable instructions to determine a location for each of the one or more traffic signals that the emergency vehicle will pass through in the received route. The one or more processors may be further configured to execute the computer-executable instructions to compare the current location of the emergency vehicle to the location for each of the one or more traffic signals that the emergency vehicle will pass through in the received route. The one or more processors may be further configured to execute the computer-executable instructions to determine, based at least in part on the comparison, an estimated time range that the emergency vehicle will get to each of the locations for each of the one or more traffic signals that the emergency vehicle will pass through in the received route, wherein the predetermined valid time period for each of the one or more traffic signal time-bounded intersection tickets may be based at least in part on the determined estimated time range for the corresponding one or more traffic signals. The one or more processors may be further configured to execute the computer-executable instructions to receive a vehicle type description for the emergency vehicle; generate the identifying credential for the emergency vehicle; and transmit, the identifying credential for storage at the emergency vehicle.

In example embodiments of the disclosure, there may be a system that may include a means for receiving, from an emergency communications network, an identifying credential for an emergency vehicle. The system may include a means for receiving, from the emergency communications network, routing information for the emergency vehicle, wherein the routing information indicates a route the emergency vehicle will proceed in. The system may include a means for determining one or more traffic signals the emergency vehicle will pass through in the received route. The system may include a means for generating one or more traffic signal time-bounded intersection tickets, wherein one traffic signal time-bounded intersection ticket may be generated for each of the one or more traffic signals the emergency vehicle will pass through and wherein each traffic signal time-bounded intersection ticket may include a predetermined valid time period. The system may include a means for generating an emergency vehicle time-bounded intersection ticket. The system may include a means for transmitting each of the one or more traffic signal time-bounded intersection tickets to the corresponding one or more traffic signals the emergency vehicle will pass through. The system may include a means for transmitting the identifying credential for the emergency vehicle to the one or more traffic signals the emergency vehicle will pass through. The system may include a means for transmitting the emergency vehicle time-bounded intersection ticket to the emergency vehicle. The system may further include a means for determining one or more tollgates the emergency vehicle will pass through in the received route; a means for generating one or more tollgate time-bounded intersection tickets, wherein one tollgate time-bounded intersection ticket may be generated for each of the one or more tollgates the emergency vehicle will pass through and wherein each tollgate time-bounded intersection ticket may include a corresponding predetermined valid time period; a means for transmitting each of the one or more tollgate time-bounded intersection tickets to the corresponding one or more tollgates the emergency vehicle will pass through; and a means for transmitting the identifying credential for the emergency vehicle to the one or more tollgates the emergency vehicle will pass through. The system may further include a means for determining a current location of the emergency vehicle; a means for determining a location for each of the one or more traffic signals that the emergency vehicle will pass through in the received route; a means for comparing the current location of the emergency vehicle to the location for each of the one or more traffic signals that the emergency vehicle will pass through in the received route; and a means for determining, based at least in part on the comparison, an estimated time range that the emergency vehicle will get to each of the locations for each of the one or more traffic signals that the emergency vehicle will pass through in the received route, wherein the predetermined valid time period for each of the one or more traffic signal time-bounded intersection tickets may be based at least in part on the determined estimated time range for the corresponding one or more traffic signals. The system may further include a means for receiving a vehicle type description for the emergency vehicle; a means for generating the identifying credential for the emergency vehicle; and a means for transmitting, the identifying credential for storage at the emergency vehicle.

In example embodiments of the disclosure, there may be a computer-implemented method. The computer-implemented method may include receiving, by a traffic signal controller comprising at least one processor from a dispatch server, a time-bounded intersection ticket, wherein the time-bounded intersection ticket may include a predetermined valid time period. The computer-implemented method may include receiving, by the traffic signal controller from the dispatch server, a first identifying credential for an emergency vehicle. The computer-implemented method may include receiving, by the traffic signal controller from the emergency vehicle, an encrypted traffic light control message. The computer-implemented method may include decrypting, by the traffic signal controller, the traffic light control message with a key associated with the time-bounded intersection ticket. The computer-implemented method may include determining, by the traffic signal controller and based at least in part on an evaluation of the contents of the traffic light control message, if the traffic light control message may be a valid request to provide expedited access at a traffic signal for the emergency vehicle. With regard to determining if the traffic light control message may be a valid request to provide expedited access at a traffic signal or tollgate for the emergency vehicle, the computer-implemented method may further include identifying, by the traffic signal controller, a second identifying credential for the emergency vehicle in the traffic light control message; comparing, by the traffic signal controller, the first identifying credential to the second identifying credential to determine if the first identifying credential matches the second identifying credential; determining, by the traffic signal controller, a time of receipt of the traffic light control message; comparing, by the traffic signal controller, the time of receipt to the predetermined valid time period of the time-bounded intersection ticket to determine if the time of receipt may be within the predetermined valid time period; and determining, by the traffic signal controller and based at least in part on the first identifying credential matching the second identifying credential and the time of receipt being within the predetermined valid time period, that the traffic light control message may be the valid request to provide expedited access at the traffic signal for the emergency vehicle. With regard to determining if the traffic light control message may be a valid request to provide expedited access at a traffic signal or tollgate for the emergency vehicle, the computer-implemented method may further include determining, by the traffic signal controller, if a second traffic light control message includes the second identifying credential for the emergency vehicle was received prior to the receipt of the traffic light control message from the emergency vehicle, wherein determining that the traffic light control message may be the valid request may be further based at least in part on the determination that the second traffic light control message includes the second identifying credential for the emergency vehicle was not received prior to the receipt of the traffic light control message. The computer-implemented method may further include determining, by the traffic signal controller, a current signal displayed at the traffic signal, and determining, by the traffic signal controller and based at least in part on the current signal, if the current signal needs to be changed at the traffic signal. The computer-implemented method may further include initiating, by the traffic signal controller, a change sequence at the traffic signal based on a positive determination that the current signal needs to be changed. The computer-implemented method may further include maintaining, by the traffic signal controller, the current signal for an additional predetermined amount of time based on a negative determination that the current signal needs to be changed.

In example embodiments of the disclosure, there may be an apparatus. The apparatus may include one or more traffic control signals, such as traffic lights or tollgates. The apparatus may further include a transceiver configured to transmit and receive wireless signals; at least one memory that stores computer-executable instructions, and at least one processor of the one or more processors configured to access the at least one memory; and one or more processors that may be communicably coupled to the transceiver and configured to execute the computer-executable instructions to: receive a time-bounded intersection ticket, wherein the time-bounded intersection ticket may include a predetermined valid time period. The at least one processor of the one or more processors may be configured to execute the computer-executable instructions to receive a first identifying credential for an emergency vehicle. The at least one processor of the one or more processors may be configured to execute the computer-executable instructions to receive, from an emergency vehicle, an encrypted traffic light control message. The at least one processor of the one or more processors may be configured to execute the computer-executable instructions to decrypt the traffic light control message with a key associated with the time-bounded intersection ticket. The at least one processor of the one or more processors may be configured to execute the computer-executable instructions to determine, based at least in part on an evaluation of the contents of the traffic light control message, if the traffic light control message may be a valid request to provide expedited access at a traffic signal for the emergency vehicle. With regard to determining if the traffic light control message may be a valid request to provide expedited access at a traffic signal or tollgate for the emergency vehicle, the at least one processor of the one or more processors may be further configured to execute the computer-executable instructions to identify a second identifying credential for the emergency vehicle in the traffic light control message; compare the first identifying credential to the second identifying credential to determine if the first identifying credential matches the second identifying credential; determine a time of receipt of the traffic light control message; compare the time of receipt to the predetermined valid time period of the time-bounded intersection ticket to determine if the time of receipt may be within the predetermined valid time period; and determine, based at least in part on the first identifying credential matching the second identifying credential and the time of receipt being within the predetermined valid time period, that the traffic light control message may be the valid request to provide expedited access at the traffic signal for the emergency vehicle. With regard to determining if the traffic light control message may be a valid request to provide expedited access at a traffic signal or tollgate for the emergency vehicle, the at least one processor of the one or more processors may be configured to execute the computer-executable instructions to determine if a second traffic light control message including the second identifying credential for the emergency vehicle was received prior to the receipt of the traffic light control message from the emergency vehicle, wherein determining that the traffic light control message may be the valid request may be further based at least in part on the determination that the second traffic light control message includes the second identifying credential for the emergency vehicle was not received prior to the receipt of the traffic light control message. The at least one processor of the one or more processors may be further configured to execute the computer-executable instructions to determine a current signal displayed at the traffic signal, and determine, based at least in part on the current signal, if the current signal needs to be changed at the traffic signal. The at least one processor of the one or more processors may be further configured to execute the computer-executable instructions to initiate a change sequence at the traffic signal based on a positive determination that the current signal needs to be changed. The at least one processor of the one or more processors may be further configured to execute the computer-executable instructions to maintain the current signal for an additional predetermined amount of time based on a negative determination that the current signal needs to be changed.

In example embodiments of the disclosure, there may be a system. The system may include a means for receiving, from a dispatch server, a time-bounded intersection ticket, wherein the time-bounded intersection ticket may include a predetermined valid time period. The system may include a means for receiving, from the dispatch server, a first identifying credential for an emergency vehicle. The system may include a means for receiving, from the emergency vehicle, an encrypted traffic light control message. The system may include a means for decrypting the traffic light control message with a key associated with the time-bounded intersection ticket. The system may include a means for determining, based at least in part on an evaluation of the contents of the traffic light control message if the traffic light control message may be a valid request to provide expedited access at a traffic signal for the emergency vehicle. With regard to a means for determining if the traffic light control message may be a valid request to provide expedited access at a traffic signal or tollgate for the emergency vehicle, the system may further include a means for identifying a second identifying credential for the emergency vehicle in the traffic light control message; a means for comparing the first identifying credential to the second identifying credential to determine if the first identifying credential matches the second identifying credential; a means for determining a time of receipt of the traffic light control message; a means for comparing the time of receipt to the predetermined valid time period of the time-bounded intersection ticket to determine if the time of receipt may be within the predetermined valid time period; and a means for determining, based at least in part on the first identifying credential matching the second identifying credential and the time of receipt being within the predetermined valid time period, that the traffic light control message may be the valid request to provide expedited access at the traffic signal for the emergency vehicle. With regard to the system including a means for determining if the traffic light control message maybe a valid request to provide expedited access at a traffic signal or tollgate for the emergency vehicle, the system may further include a means for determining if a second traffic light control message includes the second identifying credential for the emergency vehicle was received prior to the receipt of the traffic light control message from the emergency vehicle, wherein a means for determining that the traffic light control message may be the valid request may be further based at least in part on the determination that the second traffic light control message includes the second identifying credential for the emergency vehicle was not received prior to the receipt of the traffic light control message. The system may further include a means for determining a current signal displayed at the traffic signal, and a means for determining, based at least in part on the current signal, if the current signal needs to be changed at the traffic signal. The system may further include a means for initiating a change sequence at the traffic signal based on a positive determination that the current signal needs to be changed. The system may further include a means for maintaining the current signal for an additional predetermined amount of time based on a negative determination that the current signal needs to be changed.

The claimed invention is:

1. A non-transitory computer-readable medium comprising computer-executable instructions that, when executed by one or more processors, cause the one or more processors to perform operations comprising:

receiving, from an emergency communications network, an identifying credential for an emergency vehicle;

receiving, from the emergency communications network, routing information for the emergency vehicle, wherein the routing information indicates a route the emergency vehicle will proceed in;

determining one or more traffic signals the emergency vehicle will pass through in the received route;

generating one or more traffic signal time-bounded intersection tickets, wherein one traffic signal time-bounded intersection ticket is generated for each of the one or more traffic signals the emergency vehicle will pass through and wherein each traffic signal time-bounded intersection ticket comprises a predetermined valid time period;

generating an emergency vehicle time-bounded intersection ticket;

transmitting each of the one or more traffic signal time-bounded intersection tickets to the corresponding one or more traffic signals the emergency vehicle will pass through;

transmitting the identifying credential for the emergency vehicle to the one or more traffic signals the emergency vehicle will pass through; and transmitting the emergency vehicle time-bounded intersection ticket to the emergency vehicle.

2. The non-transitory computer-readable media of claim 1, wherein the operations further comprise:

determining one or more tollgates the emergency vehicle will pass through in the received route;

generating one or more tollgate time-bounded intersection tickets, wherein one tollgate time-bounded intersection ticket is generated for each of the one or more tollgates the emergency vehicle will pass through and wherein each tollgate time-bounded intersection ticket comprises a corresponding predetermined valid time period;

transmitting each of the one or more tollgate time-bounded intersection tickets to the corresponding one or more tollgates the emergency vehicle will pass through; and transmitting the identifying credential for the emergency vehicle to the one or more tollgates the emergency vehicle will pass through.

3. The non-transitory computer-readable media of claim 1, wherein the operations further comprise:

determining a current location of the emergency vehicle;

determining a location for each of the one or more traffic signals that the emergency vehicle will pass through in the received route;

comparing the current location of the emergency vehicle to the location for each of the one or more traffic signals that the emergency vehicle will pass through in the received route; and determining, based at least in part on the comparison, an estimated time range that the emergency vehicle will get to each of the locations for each of the one or more traffic signals that the emergency vehicle will pass through in the received route;

wherein the predetermined valid time period for each of the one or more traffic signal time-bounded intersection tickets is based at least in part on the determined estimated time range for the corresponding one or more traffic signals.

4. The non-transitory computer-readable media of claim 1, wherein the operations further comprise:

receiving a vehicle type description for the emergency vehicle;

generating the identifying credential for the emergency vehicle; and transmitting, the identifying credential for storage at the emergency vehicle.

5. A non-transitory computer-readable medium comprising computer-executable instructions that, when executed by one or more processors, cause the one or more processors to perform operations comprising:

receiving, from a dispatch server, a time-bounded intersection ticket, wherein the time-bounded intersection ticket comprises a predetermined valid time period;

receiving, from the dispatch server, a first identifying credential for an emergency vehicle;

receiving, from the emergency vehicle, an encrypted traffic light control message;

decrypting the traffic light control message with a key associated with the time-bounded intersection ticket; and determining, based at least in part on an evaluation of the contents of the traffic light control message if the traffic light control message is a valid request to provide expedited access at a traffic signal for the emergency vehicle.

6. The non-transitory computer-readable media of claim 5, wherein determining if the traffic light control message is a valid request to provide expedited access at a traffic signal or tollgate for the emergency vehicle further comprises the operations of:

identifying a second identifying credential for the emergency vehicle in the traffic light control message;

comparing the first identifying credential to the second identifying credential to determine if the first identifying credential matches the second identifying credential;

determining a time of receipt of the traffic light control message;

comparing the time of receipt to the predetermined valid time period of the time-bounded intersection ticket to determine if the time of receipt is within the predetermined valid time period;

determining, based at least in part on the first identifying credential matching the second identifying credential and the time of receipt being within the predetermined valid time period, that the traffic light control message is the valid request to provide expedited access at the traffic signal for the emergency vehicle.

7. The non-transitory computer-readable media of claim 6, wherein determining if the traffic light control message is a valid request to provide expedited access at a traffic signal or tollgate for the emergency vehicle further comprises the operations of:

determining if a second traffic light control message comprising the second identifying credential for the emergency vehicle was received prior to the receipt of the traffic light control message from the emergency vehicle;

wherein determining that the traffic light control message is the valid request is further based at least in part on the determination that the second traffic light control message comprising the second identifying credential for the emergency vehicle was not received prior to the receipt of the traffic light control message.

8. The non-transitory computer-readable media of claim 6, wherein the operations further comprise:

determining a current signal displayed at the traffic signal; and determining, based at least in part on the current signal, if the current signal needs to be changed at the traffic signal.

9. The non-transitory computer-readable media of claim 8, wherein the operations further comprise initiating a change sequence at the traffic signal based on a positive determination that the current signal needs to be changed.

10. The non-transitory computer-readable media of claim 8, wherein the operations further comprise maintaining the current signal for an additional predetermined amount of time based on a negative determination that the current signal needs to be changed.

11. A system, comprising:

at least one memory that stores computer-executable instructions;

at least one processor configured to access the at least one memory, wherein the at least one processor is configured to execute the computer-executable instructions to:

receive, from an emergency communications network, an identifying credential for an emergency vehicle;

receive, from the emergency communications network, routing information for the emergency vehicle, wherein the routing information indicates a route the emergency vehicle will proceed in;

determine one or more traffic signals the emergency vehicle will pass through in the received route;

generate one or more traffic signal time-bounded intersection tickets, wherein one traffic signal time-bounded intersection ticket is generated for each of the one or more traffic signals the emergency vehicle will pass through and wherein each traffic signal time-bounded intersection ticket comprises a predetermined valid time period;

generate an emergency vehicle time-bounded intersection ticket;

direct communication of each of the one or more traffic signal time-bounded intersection tickets to the corresponding one or more traffic signals the emergency vehicle will pass through;

direct communication of the identifying credential for the emergency vehicle to the one or more traffic signals the emergency vehicle will pass through; and direct communication of the emergency vehicle time-bounded intersection ticket to the emergency vehicle.

12. The system of claim 11, wherein the at least one processor is further configured to execute the computer-executable instructions to:

determine one or more tollgates the emergency vehicle will pass through in the received route;

generate one or more tollgate time-bounded intersection tickets, wherein one tollgate time-bounded intersection ticket is generated for each of the one or more tollgates the emergency vehicle will pass through and wherein each tollgate time-bounded intersection ticket comprises a corresponding predetermined valid time period;

direct communication of each of the one or more tollgate time-bounded intersection tickets to the corresponding one or more tollgates the emergency vehicle will pass through; and direct communication of the identifying credential for the emergency vehicle to the one or more tollgates the emergency vehicle will pass through.

13. The system of claim 11, wherein the at least one processor is further configured to execute the computer-executable instructions to:

determine a current location of the emergency vehicle;

determine a location for each of the one or more traffic signals that the emergency vehicle will pass through in the received route;

compare the current location of the emergency vehicle to the location for each of the one or more traffic signals that the emergency vehicle will pass through in the received route; and determine, based at least in part on the comparison, an estimated time range that the emergency vehicle will get to each of the locations for each of the one or more traffic signals that the emergency vehicle will pass through in the received route;

wherein the predetermined valid time period for each of the one or more traffic signal time-bounded intersection tickets is based at least in part on the determined estimated time range for the corresponding one or more traffic signals.

14. The system of claim 11 wherein the at least one processor is further configured to execute the computer-executable instructions to:

receive a vehicle type description for the emergency vehicle;

generate the identifying credential for the emergency vehicle; and direct communication of the identifying credential for storage at the emergency vehicle.

15. A system, comprising:

at least one memory that stores computer-executable instructions;

at least one processor configured to access the at least one memory, wherein the at least one processor is configured to execute the computer-executable instructions to:

receive, from a dispatch server, a time-bounded intersection ticket, wherein the time-bounded intersection ticket comprises a predetermined valid time period;

receive, from the dispatch server, a first identifying credential for an emergency vehicle;

receive, from the emergency vehicle, an encrypted traffic light control message;

decrypt the traffic light control message with a key associated with the time-bounded intersection ticket; and determine, based at least in part on an evaluation of contents of the traffic light control message if the traffic light control message is a valid request to provide expedited access at a traffic signal for the emergency vehicle.

16. The system of claim 15, wherein the at least one processor is further configured determine if the traffic light control message is a valid request to provide expedited access at a traffic signal or tollgate for the emergency vehicle by executing the computer-executable instructions to:

identify a second identifying credential for the emergency vehicle in the traffic light control message;

compare the first identifying credential to the second identifying credential to determine if the first identifying credential matches the second identifying credential;

determine a time of receipt of the traffic light control message;

compare the time of receipt to the predetermined valid time period of the time-bounded intersection ticket to determine if the time of receipt is within the predetermined valid time period;

determine, based at least in part on the first identifying credential matching the second identifying credential and the time of receipt being within the predetermined valid time period, that the traffic light control message is the valid request to provide expedited access at the traffic signal for the emergency vehicle.

17. The system of claim 16, wherein the at least one processor is further configured determine if the traffic light control message is a valid request to provide expedited access at a traffic signal or tollgate for the emergency vehicle by executing the computer-executable instructions to:

determine if a second traffic light control message comprising the second identifying credential for the emergency vehicle was received prior to the receipt of the traffic light control message from the emergency vehicle;

wherein determining that the traffic light control message is the valid request is further based at least in part on the determination that the second traffic light control message comprising the second identifying credential for the emergency vehicle was not received prior to the receipt of the traffic light control message.

18. The system of claim 16, wherein the at least one processor is further configured to execute the computer-executable instructions to:

determine a current signal displayed at the traffic signal; and determine, based at least in part on the current signal, if the current signal needs to be changed at the traffic signal.

19. The system of claim 18, wherein the at least one processor is further configured to execute the computer-executable instructions to initiate a change sequence at the traffic signal to change the current signal to a second signal based on a positive determination that the current signal needs to be changed.

20. The system of claim 18, wherein the at least one processor is further configured to execute the computer-executable instructions to maintain the current signal for an additional predetermined amount of time based on a negative determination that the current signal needs to be changed.

* * * * *